US009948070B2

(12) United States Patent
Kawade et al.

(10) Patent No.: US 9,948,070 B2
(45) Date of Patent: Apr. 17, 2018

(54) SPARK PLUG

(71) Applicant: NGK SPARK PLUG CO., LTD., Nagoya-shi, Aichi (JP)

(72) Inventors: Takuya Kawade, Hashima (JP); Yuichi Yamada, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/546,875

(22) PCT Filed: Jan. 29, 2016

(86) PCT No.: PCT/JP2016/000476
§ 371 (c)(1),
(2) Date: Jul. 27, 2017

(87) PCT Pub. No.: WO2016/132687
PCT Pub. Date: Aug. 25, 2016

(65) Prior Publication Data

US 2018/0019579 A1 Jan. 18, 2018

(30) Foreign Application Priority Data

Feb. 16, 2015 (JP) ..... 2015-027156
Dec. 2, 2015 (JP) ..... 2015-235545

(51) Int. Cl.
*H01T 13/20* (2006.01)
*H01T 13/39* (2006.01)
(Continued)

(52) U.S. Cl.
CPC ..... *H01T 13/39* (2013.01); *H01T 13/32* (2013.01); *H01T 21/02* (2013.01); *C22C 1/0466* (2013.01)

(58) Field of Classification Search
USPC ..... 313/141, 118
See application file for complete search history.

(56) References Cited

FOREIGN PATENT DOCUMENTS

JP S57-17590 A 1/1982 ..... H01T 13/20
JP 2004-152682 A 5/2004 ..... C22C 5/04
(Continued)

OTHER PUBLICATIONS

International Search Report issued in corresponding International Patent Application No. PCT/JP2016/000476, dated May 10, 2016.
(Continued)

*Primary Examiner* — Vip Patel
(74) *Attorney, Agent, or Firm* — Kusner & Jaffe

(57) ABSTRACT

A spark plug includes an insulator, a metal shell surrounding the insulator, a center electrode disposed in the insulator, with a front end thereof exposed outside from the insulator, a ground electrode having a fixed end portion fixed to the metal shell and a free end portion located at a predetermined gap apart from the center electrode, and a coating part formed of noble metal or noble metal alloy so as to cover at least a region of an inner surface of the ground electrode from a first intersection to a second intersection, where the first intersection is an intersection at which an imaginary line extending from an outer circumference of the center electrode intersects the ground electrode; and the second intersection is an intersection at which an imaginary plane extending through a midpoint of the predetermined gap in parallel with the front end intersects the ground electrode.

9 Claims, 27 Drawing Sheets

(51) Int. Cl.

| | |
|---|---|
| ***H01T 21/02*** | (2006.01) |
| ***H01T 13/32*** | (2006.01) |
| *C22C 1/04* | (2006.01) |

(56) References Cited

FOREIGN PATENT DOCUMENTS

| | | | | |
|---|---|---|---|---|
| JP | 2007-265842 A | 10/2007 | ..... | F02P 13/00 |
| JP | 2008-204882 A | 9/2008 | ..... | H01T 13/20 |

OTHER PUBLICATIONS

Office Action issued in corresponding Japanese Patent Application No. 2015-235545, dated May 10, 2017.

FIG. 40A
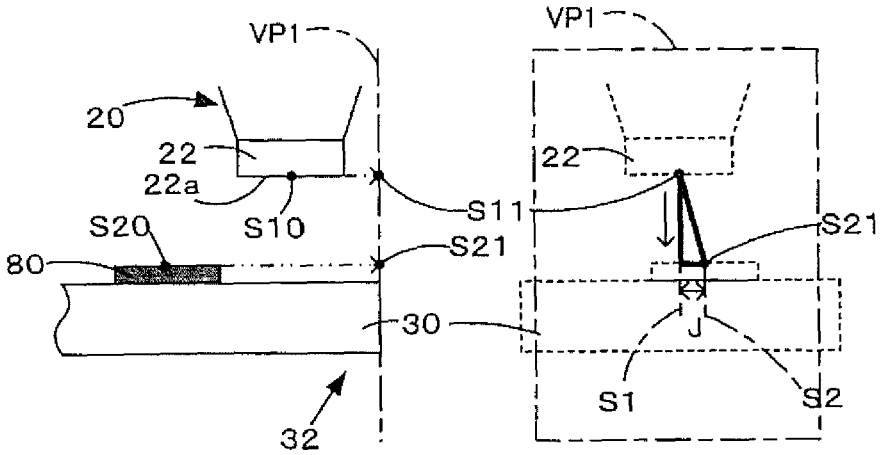
FIG. 40B
FIG. 41
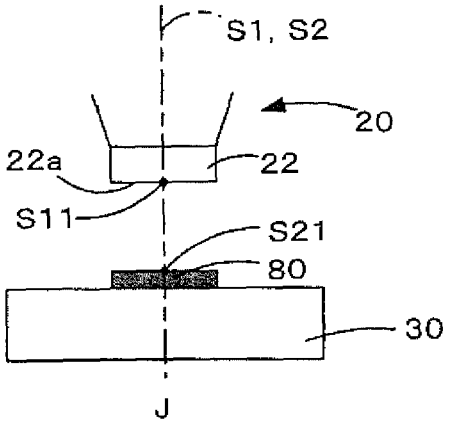

SPARK PLUG

RELATED APPLICATIONS

This application is a National Stage of International Application No. PCT/JP16/00476 filed Jan. 29, 2016, which claims the benefit of Japanese Patent Application No. 2015-027156, filed Feb. 16, 2015 and Japanese Patent Application No. 2015-235545, filed Dec. 2, 2015, the entire contents of which are incorporated herein by reference.

FIELD OF THE INVENTION

The present invention relates to a spark plug used for ignition of air-fuel mixture in an internal combustion engine.

BACKGROUND OF THE INVENTION

Conventionally, various proposals have been made on design modifications for ground electrodes of spark plugs and techniques for suppressing wear of electrodes of spark plugs in order to attain improvements in ignition performance and flame propagation (see, for example, Japanese Laid-Open Patent Publication No. 2008-204882 and Japanese Laid-Open Patent Publication No. 2007-265842).

In recent years, there is a tendency that the air-fuel ratio is often set leaner than the stoichiometric air-fuel ratio during vehicle driving so as to improve vehicle fuel efficiency and to conform with exhaust emission regulation which gets stricter year after year. For improvement of vehicle fuel efficiency and conformity with exhaust gas regulation, complete combustion of air-fuel mixture is required irrespective of its air-fuel ratio. This results in a need to improve ignition performance in an air-fuel ratio range leaner than the stoichiometric air-fuel ratio. It has thus been attempted to improve ignition performance e.g. by increasing the value (energy) of electric current applied to the spark plug to generate a larger spark at ignition and by increasing the time for energization of the spark plug.

With the increase of the spark size and the increase of the energization time, however, it becomes likely that blowing of sparks will occur. The degree of wear of the ground electrode base material increases with increase in the frequency of exposure to blowing of sparks. As a result, there arises the possibility of misfiring due to separation of a noble metal tip from the ground electrode, breakage of the ground electrode etc. In particular, the wear of a basal end portion of the ground electrode leads to breakage of the ground electrode so that the spark plug becomes unable to perform its function. In the case of protecting the ground electrode by simply applying a coating of noble metal etc. to the ground electrode, on the other hand, it becomes likely that abnormal combustion will occur. In the conventional arts, sufficient considerations are not given to these problems.

There has accordingly been a demand to provide a spark plug capable of suppressing wear of a base material of a ground electrode and suppressing abnormal combustion.

The present invention has been made to address the above-mentioned problems and can be embodied in the following aspects.

SUMMARY OF THE INVENTION

According to a first aspect of the present invention, there is provided a spark plug comprising: an insulator having an axial hole; a metal shell surrounding an outer circumference of the insulator; a center electrode having a center electrode base material disposed in the axial hole and an electrode tip joined to the center electrode base material and exposed outside from a front end portion of the metal shell; and a ground electrode having a fixed end portion fixed to the metal shell and a free end portion located at a predetermined gap apart from a front end of the electrode tip, the ground electrode having an inner surface facing the center electrode and the insulator and having a center electrode-facing site opposed to and facing the center electrode, wherein the spark plug further comprises a coating part formed of noble metal or noble metal alloy such that the coating part covers at least a region of the inner surface from a first intersection to a second intersection, where the first intersection is defined as containing an intersection point at which an imaginary line extending from an outer circumference of the center electrode base material at a side of the fixed end portion to the ground electrode intersects the ground electrode; and the second intersection is defined as an intersection at which an imaginary plane passing through a midpoint of the predetermined gap and extending in parallel with an end face of the front end intersects the ground electrode; wherein the spark plug satisfies a relationship of $0.7F \leq A \leq B$ where A is a dimension of the coating part in a width direction; B is a dimension of the ground electrode in the width direction; and F is a width of the front end of the electrode tip; and wherein, when the ground electrode, the coating part and the electrode tip are visually observed from a side of the free end portion, a center line of the coating part perpendicular to the width direction is in a range of the width of the electrode tip.

It is possible according to the first aspect to effectively suppress wear of the ground electrode base material and the occurrence of abnormal combustion.

In the spark plug according to the first aspect, the first intersection may be defined as an intersection at which an imaginary plane containing the imaginary line, passing tangent to the outer circumference of the center electrode base material and extending to the ground electrode intersects the ground electrode.

In the spark plug according to the first aspect, the center electrode-facing site, which is opposed to and facing the center electrode, may be included in the free end portion of the ground electrode; and the coating part may cover a region of the inner surface from an insulator-facing site, which is opposed to and facing a front end portion of the insulator at a side of the fixed end portion, to the center electrode-facing site. In this case, it is possible to more effectively suppress wear of the ground electrode base material and the occurrence of abnormal combustion.

In the spark plug according to the first aspect, the coating part may cover the whole of the inner surface. Even in this case, it is possible to more effectively suppress wear of the ground electrode base material and the occurrence of abnormal combustion.

In the spark plug according to the first aspect, the ground electrode may have an outer surface connecting one end and the other end of the inner surface in the width direction; and the coating part may further cover a region of the outer surface continuing to the inner surface. In this case, it is possible to effectively suppress or prevent abnormal combustion caused due to the formation of the coating part.

In the spark plug according to the first aspect, the region of the outer surface continuing to the inner surface may be a region located closer to the inner surface than an imaginary line passing through the outer surface from a geometrical center of gravity of an end face of the ground electrode when visually observed from the side of the free end portion and extending in parallel with the inner surface. In this case, it is possible to more effectively suppress or prevent abnormal combustion caused due to the formation of the coating part.

In the spark plug according to the first aspect, the coating part may have a thickness of 3 μm to 400 μm. In this case, it is possible to effectively prevent wear of the ground electrode base material and increase adhesion between the coating part and the ground electrode base material.

In the spark plug according to the first aspect, a thickness of the coating part formed on the center electrode-facing site is larger than a thickness of the coating part formed on any site other than the center electrode-facing site. In this case, it is possible to effectively suppress or prevent wear of the ground electrode base material at the wear-susceptible area.

In the spark plug according to the first aspect, a composition of the coating part formed on the center electrode-facing site is different from a composition of the coating part formed on any site other than the center electrode-facing site. In this case, it is also possible to effectively suppress or prevent wear of the ground electrode base material at the wear-susceptible area.

BRIEF DESCRIPTION OF DRAWINGS

FIGS. 40A and 40B show schematic views explaining the positional relationship between a coating part and a front end of an electrode top in Experimental Examples 20 to 24.

FIG. 41 shows an enlarged right-side view of a front end part of a spark plug with a coating part formed on a ground electrode according to Experimental Example 20 of the present embodiment.

DESCRIPTION OF EMBODIMENTS

Figure 1:
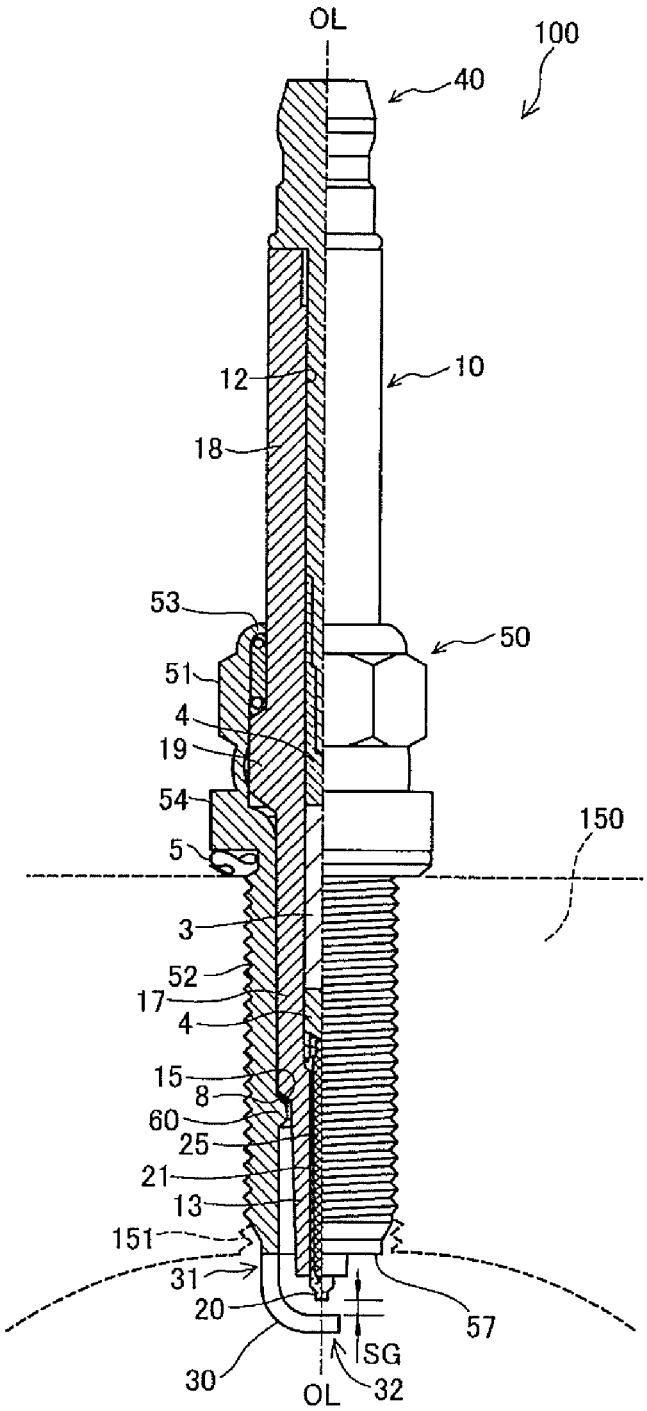
FIG. 1 shows a schematic view, partially in cross section, of a spark plug according to a present embodiment of the invention.

Hereinafter, a spark plug 100 as a spark plug according to the present embodiment of the invention will be described below with reference to the drawings. FIG. 1 shows a schematic view, partially in cross section, of the spark plug according to the present embodiment. In FIG. 1, a longitudinal center axis of the spark plug 100 is indicated as an axis CL by an alternate long and short dash line. The right side of FIG. 1 with respect to the axis CL shows an outside elevation view of the spark plug 100, whereas the left side of FIG. 1 with respect to the axis CL shows a cross-sectional view of the spark plug 100 taken along the center axis of the spark plug 100. In the following description, the term "front" refers to a bottom side of FIG. 1 in the direction of the axis CL of the spark plug 100, i.e., a side of the spark plug 100 exposed to a combustion chamber; and the term "rear" refers to a top side of FIG. 1 in the direction of the axis CL of the spark plug 100, i.e., a plug attachment side of the spark plug 100. The spark plug 100 has an insulator 10, a center electrode 20, a ground electrode 30, a terminal electrode 40 and a metal shell 50.

The insulator 10 is formed in a cylindrical shape by firing a ceramic material such as alumina. An axial hole 12 is made through the center of the insulator 10 in the direction of the axis CL such that the center electrode 20 and the terminal electrode 20 are placed in the axial hole 12. The insulator 10 includes: a middle body portion 19 located at a middle position thereof in the direction of the axis CL and having the largest outer diameter throughout the insulator 10; a rear body portion 19 located rearward of the middle body portion 18 so as to provide insulation between the terminal electrode 50 and the metal shell 40; a front body portion 17 located frontward of the middle body portion 18 and having an outer diameter smaller than that of the rear body portion 19; a leg portion 13 located frontward of the front body portion 17 and having an outer diameter smaller than that of the front body portion 17 and gradually decreasing toward the center electrode 20; and a diameter-decreasing portion 15 located between the front body portion 17 and the leg portion 13 and having an outer diameter gradually decreasing toward the front so as to connect the front body portion 17 and the leg portion 13 to each other.

The center electrode 20 is inserted in the axial hole 12. The center electrode 20 has a rod shape and includes: a bottomed cylindrical-shaped center electrode base material 21; and a core 25 having higher thermal conductivity than that of the center electrode base material 21 and fitted in the center electrode base material 21. In the present embodiment, the center electrode base material 21 is formed of a nickel alloy containing nickel (Ni) as a main component; and the core 25 is formed of copper or an alloy containing copper as a main component. An electrode tip 22 of noble metal or noble metal alloy such as iridium alloy is joined to a front end of the center electrode base material 21 (see FIGS. 2A and 2B and FIGS. 3A and 3B). The electrode tip 22 is generally formed in a cylindrical column shape, but can alternatively be formed in any other shape such as rectangular column shape. It is noted that, although the electrode tip 22 is provided in the same manner as above in the drawings other than FIGS. 2A and 2B and FIGS. 3A and 3B, the electrode tip 22 may be omitted from illustration for simplicity purposes. The center electrode 20 is held by the insulator 10 in the axial hole 12 with the electrode tip 22 protruding and exposed outside from the axial hole 12 (insulator 10). Further, the center electrode 20 is electrically connected to the terminal electrode 40 via a ceramic resistor 3 and a seal member 4 within the axial hole 12. In the following description, the front end and front end face of the electrode tip 22 are sometimes comprehensively referred to as the front end and front end face of the center electrode 20.

The ground electrode 30 is made of a high corrosion-resistant metal material. By way of example, a nickel alloy is used as the base material of the ground electrode 30 in the present embodiment. A fixed end portion (basal end portion) 31 of the ground electrode 30 is fixed by welding to a front end face 57 of the metal shell 50. The ground electrode 30 extends from the fixed end portion 31, and is bent or curved toward the center electrode 20 such that a free end portion (distal end portion) 32 of the ground electrode 30 is located at a predetermined gap apart from the front end face of the center electrode 20. The free end portion 32 of the ground electrode 30 includes a center electrode-facing site 30*b* opposed to and facing the center electrode 20. The predetermined gap between the free end portion 32 of the ground electrode 30 and the front end 22*a* (front end face) of the center electrode 20 serves as a spark gap SG for spark discharge.

The terminal electrode 40 is inserted in a rear side of the axial hole 12, with a rear end portion of the terminal electrode 40 protruding and exposed outside from a rear end of the insulator 10. A high-voltage cable (not shown) is attached to the terminal electrode 40 via a plug cap (not shown) so as to apply therethrough a high voltage for spark discharge.

The metal shell 50 is cylindrical-shaped so as to circumferentially surround and hold a region of the insulator 10 extending from a point on the rear body portion 18 to over the leg portion 13. In the present embodiment, the metal shell 50 is made of low carbon steel and is entirely treated by plating such as nickel plating or zinc plating. The metal shell 50 includes a tool engagement portion 51, a mounting thread portion 52, a crimp portion 53 and a seal portion 54. The crimp portion 53, the tool engagement portion 51, the seal portion 54 and the mounting thread portion 52 are arranged in this order from the rear toward the front. The tool engagement portion 51 is engageable with a tool for mounting the spark plug 100 to a cylinder head 150 of an internal combustion engine. The mounting thread portion 51 is formed with a screw thread for screwing into a mounting thread hole 151 of the cylinder head 150.

A radially inward protruding portion 60 is formed on an inner diameter side of the mounting thread portion 52 at a position opposed to the diameter decreasing portion 15 of the ceramic insulator 10 and to the rear end side of the leg portion 13. A packing 8 as an annular seal member is arranged between the protruding portion 60 and the diameter decreasing portion 15 of the insulator 10 and is held contact with the protruding portion 60 and the diameter decreasing portion 15 so as to provide seal between the insulator 10 and the metal shell 50. A cold-rolled steel plate etc. can be used as the packing 8.

The crimp portion 53 is formed with a small thickness on a rear end side of the metal shell 50 such that the insulator 10 is held in the metal shell 50 by means of the crimp portion 53. More specifically, the crimp portion 53 is bent inwardly and pressed toward the front during manufacturing of the spark plug 100. By such bending and pressing, the insulator 10 is held integrally in the metal shell 53 with the front end of the center electrode 20 protruding from the front end of the metal shell 50. The seal portion 54 is formed in a collar shape at the bottom of the mounting thread portion 51. An annular gasket 15, which is formed by bending a plate material, is arranged between the seal portion 54 and the cylinder head. The thus-manufactured spark plug 100 is mounted in the mounting thread hole 151 of the cylinder head 150 via the metal shell 50.

In the present embodiment, the spark plug 100 has a coating part 80 formed of noble metal or noble metal alloy on the base material of the ground electrode 30 so as to suppress or prevent wear of the base material of the ground electrode 30.

The arrangement configuration and thickness of the coating part 80 on the ground electrode 30 will be verified below. Although the arrangement configuration and thickness of the coating part 80 are varied in the respective verifications, the following explanations are given to differences of the respective verifications by using common reference numerals and avoiding complicated reference numerals.

First Verification Experiment

Figure 2A:
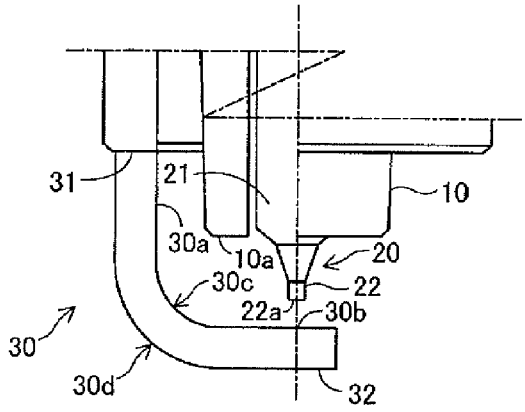
FIGS. 2A and 2B show an enlarged partially sectional elevation view and an enlarged right-side view of a front end part of a spark plug with no coating part formed on a ground electrode according to Comparative Example.
Figure 2B:
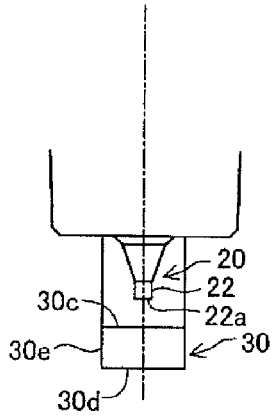
Figure 3A:
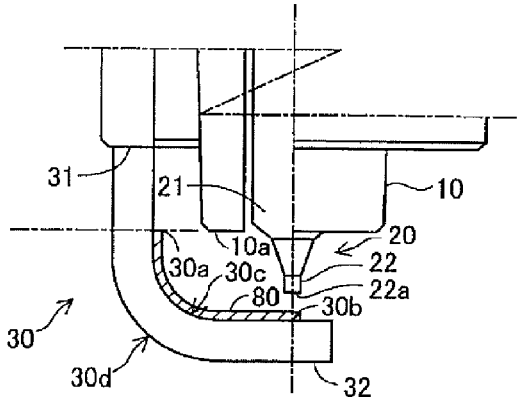
FIGS. 3A and 3B show an enlarged partially sectional elevation view and an enlarged right-side view of a front end part of a spark plug according to Experimental Example 1 of the present embodiment.
Figure 3B:
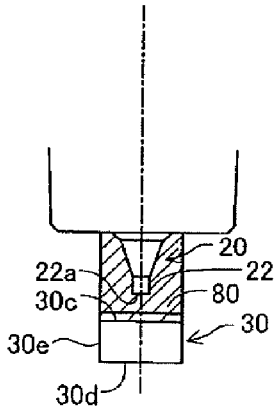
Figure 4A:
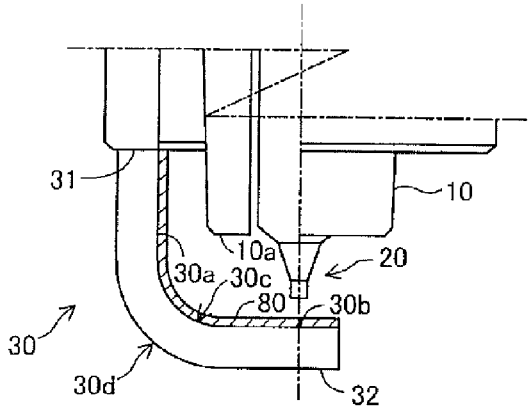
FIGS. 4A and 4B show an enlarged partially sectional elevation view and an enlarged right-side view of a front end part of a spark plug according to Experimental Example 2 of the present embodiment.
Figure 4B:
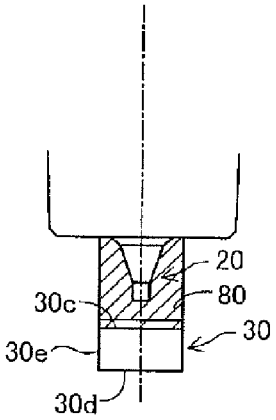
Figure 5A:
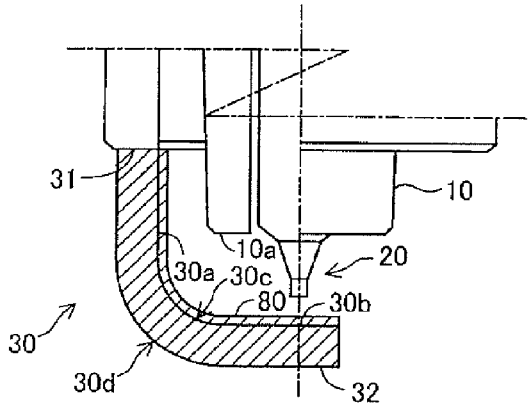
FIGS. 5A and 5B show an enlarged partially sectional elevation view and an enlarged right-side view of a front end part of a spark plug according to Experimental Example 3 of the present embodiment.
Figure 5B:
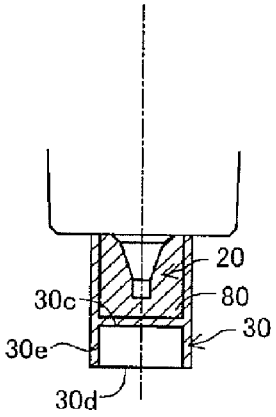
Figure 6A:
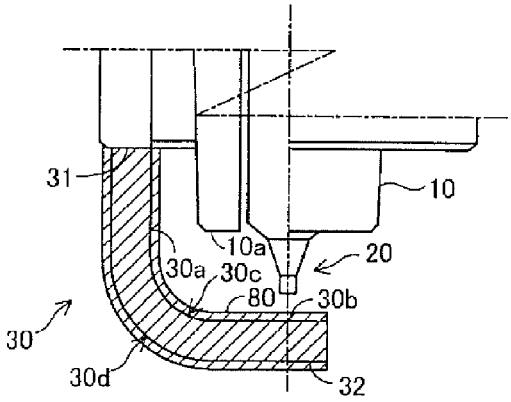
FIGS. 6A and 6B show an enlarged partially sectional elevation view and an enlarged right-side view of a front end part of a spark plug according to Experimental Example 4 of the present embodiment.
Figure 6B:
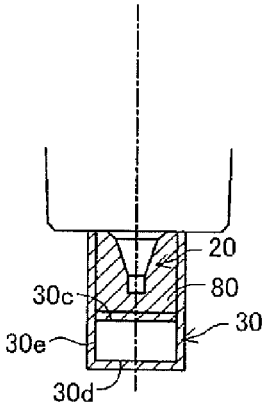

The first verification experiment is intended to verify the arrangement configuration of the coating part 80 on the ground electrode 30 from the viewpoint of suppressing or preventing wear of the base material of the ground electrode 30. FIGS. 2A and 2B show an enlarged partially sectional elevation view and an enlarged right-side view of a front end part of a spark plug with no coating part formed on a ground electrode according to Comparative Example. FIGS. 3A and 3B show an enlarged partially sectional elevation view and an enlarged right-side view of the front end part of the spark plug according to Experimental Example 1 of the present embodiment. FIGS. 4A and 4B show an enlarged partially sectional elevation view and an enlarged right-side view of the front end part of the spark plug according to Experimental Example 2 of the present embodiment. FIGS. 5A and 5B show an enlarged partially sectional elevation view and an enlarged right-side view of the front end part of the spark plug according to Experimental Example 3 of the present embodiment. FIGS. 6A and 6B show an enlarged partially sectional elevation view and an enlarged right-side view of the front end part of the spark plug according to Experimental Example 4 of the present embodiment.

The basic structure of the ground electrode 30 used in the first verification experiment is the same as that of Comparative Example shown in FIGS. 2A and 2B. The ground electrode 30 has: an inner surface 30*c* formed facing the center electrode 20 and the insulator 10; and an outer surface 30*d* formed as all surface except the inner surface 30*c*. The outer surface 30*d* can be defined as a surface connecting one end (side) to the other end (side) of the inner surface 30*c* in the width direction. In the case where the ground electrode 30 is rectangular in cross section, both of an outer surface 30*d* corresponding to a back surface opposite the inner surface 30*c* and a side surface 30*e* connecting the inner surface 30*c* and the outer surface 30*d* are included in the outer surface 30*d*. In the present specification, the outer surface 30*d* and the side surface 30*e* may be thus collectively referred to as the outer surface 30*d* in contrast to the inner surface 30*c*. In the case where the ground electrode 30 has a curved surface area connecting one end (side) to the other end (side) of the inner surface 30*c* in the width direction or in the case where the ground electrode 30 is circular in cross section, the outer surface 30 refers to the curved surface area or lower curved surface area of the ground electrode 30.

In Experimental Example 1, the coating part 80 is formed on the ground electrode 30 of the spark plug 100 so as to cover a region of the inner surface 30*c* from an insulator-facing site 30*a*, which is opposed to and facing a front end portion 10*a* of the insulator 10, to the center electrode-facing site 30*b*. In Experimental Example 2, the coating part 80 is formed on the ground electrode 30 of the spark plug 100 so as to cover the whole of the inner surface 30*c* from the fixed end (fixed end portion) 31 to the edge of the free end portion 32. In Experimental Example 3, the coating part 80 is formed on the ground electrode 30 of the spark plug 100 so as to cover the surface of the ground electrode 30 from the fixed end (fixed end portion) 31 to the edge of the free end portion 32, except the region of the outer surface 30*d* corresponding to the back surface opposite the inner surface 30*c*. In Experimental Example 4, the coating part 80 is formed on the ground electrode 30 of the spark plug 100 so as to cover the whole surface of the ground electrode 30 except an end face of the free end portion 32. As a modification example, the coating part 80 may also be formed on the end face of the free end portion 32.

It is feasible to form the coating part 80 on the ground electrode 30 by various techniques, such as surface coating treatment by electroless plating, joining of a coating material by laser welding, or formation of a coating film by PVD (physical vapor deposition) or CVD (chemical vapor deposition) etc.

For the first verification experiment, spark plug samples of Experimental Examples 1 to 4 were each prepared by forming the coating part 30 on the ground electrode 30 as explained above. In each sample, the metal shell was of M12HEX14 type (i.e. the diameter of the mounting thread portion was 12 mm; and the size (diagonal dimension) of the hexagonal portion was 14 mm); the electrode tip of iridium (Jr) with a diameter of 0.6 mm was joined to the front end of the center electrode; the spark gap SG was set to 1.1 mm; the ground electrode 30 was rectangular in shape with a width of 2.7 mm and a thickness of 1.3 mm; and the coating part 80 was formed of platinum (Pt) with a thickness of 0.4 mm on the ground electrode 30. A bench test was performed on each of the spark plug samples in a velocity field of 10 m/s airflow through the spark gap SG under the conditions of: an ignition frequency of 30 Hz; a combustion chamber pressure of 0.4 MPa; an atmosphere of nitrogen; and an endurance time of 200 hours. Then, the volume of wear of the base material of the ground electrode 30 caused during the test was measured and evaluated. In view of the flow of air-fuel mixture in the combustion chamber at spark ignition timing, the velocity field was set to allow the airflow in a direction from the center electrode 20 to the ground electrode 30. Herein, the outer dimensions of the ground electrode 30 with the coating part 80 were measured by X-ray CT scanning; the volume of the ground electrode 30 was calculated from the measured outer dimensions; and the volume of wear was determined by subtracting the volume of the ground electrode remaining after the test from the initial volume of the ground electrode.

Figure 7:
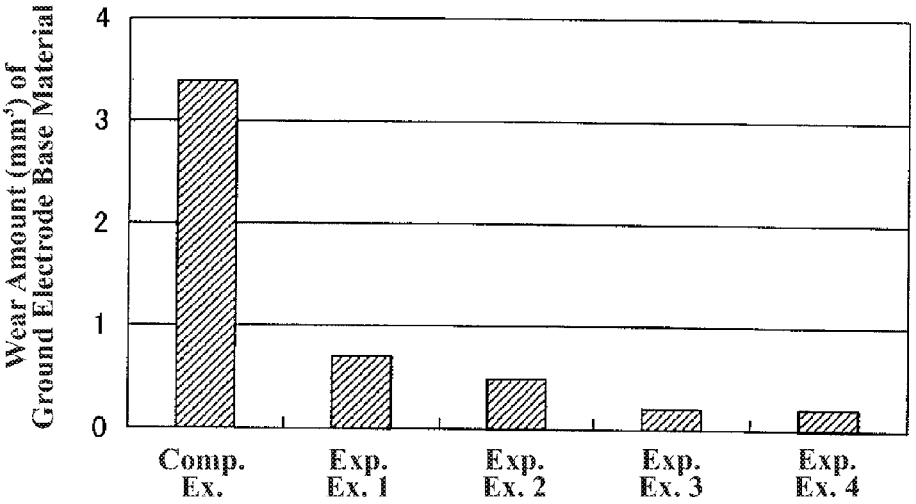
FIG. 7 shows a graph illustrating the amounts of wear of ground electrode base materials as used for Comparative Example and Experimental Examples in a first verification experiment.

The evaluation results are shown in TABLE 1 and FIG. 7. FIG. 7 shows a graph illustrating the amounts of wear of the ground electrode base materials as used for Comparative Example and Experimental Examples in the first verification experiment.

TABLE 1

| | Volume ($mm^3$) of Wear of Ground Electrode Base Material | | | | |
|---|---|---|---|---|---|
| Endurance Time (h) | Comparative Example 1 | Experimental Example 1 | Experimental Example 2 | Experimental Example 3 | Experimental Example 4 |
| 200 | 3.4 | 0.7 | 0.5 | 0.2 | 0.2 |

In the sample of Comparative Example where no coating part 80 was formed, the volume of wear of the ground electrode base material was 3.4 $mm^3$. On the other hand, the volume of wear of the ground electrode base material was less than 1.0 $mm^3$ in each of the samples of Experimental Examples 1 to 4 where the coating part 80 was formed. In each of the samples of Experimental Examples 1 and 2, the volume of wear of the ground electrode base material was reduced to a level acceptable as technically effective even though the coating part 80 was formed only on the inner surface 30*c* of the ground electrode 30. The samples of Experimental Examples 1 and 2 were different in that the coating part 80 was formed on the region of the inner surface 30 of the ground electrode 30 from the insulator-facing site 30*a* to the center electrode-facing site 30*b* (Experimental Example 1) or formed on the whole of the inner surface 30*c* of the ground electrode 30 (Experimental Example 2). However, there was no large difference in the wear volume of the ground electrode base material between Experimental Examples 1 and 2. Since the coating part 40 is formed of corrosion-resistant noble metal or noble metal alloy, a reduction of the amount of noble metal material used for the coating part 40 leads to a cost reduction. It can be concluded that Experimental Example 1 can achieve a balance in terms of suppression of wear of the base material and cost reduction. It has been shown by the above results of the first verification experiment that, as long as the coating part 80 is formed on at least the region of the inner surface of the ground electrode 30 from the insulator-facing site 30*a* to the center electrode-facing site 30*b*, it is possible to suppress or prevent wear of the ground electrode base material at the area to which sparks tend to be blown. Further, it is known that a bent or curved portion of the ground electrode 30 is susceptible to wear by sparks. In order to suppress or prevent the ground electrode from being broken from its basal end portion due to wear of the bent or curved portion of the ground electrode base material, it is preferable that the coating part 80 is formed on at least the inner surface 30*c* of the bent or curved portion of the ground electrode 30. It is also preferable that the coating part 80 is formed on the center electrode-facing site 30*b* which is most susceptible to wear by sparks. For these reasons, it is preferable that the coating part 80 is formed on at least the region of the inner surface of the ground electrode 30 from the insulator-facing site 30*a* to the center electrode-facing site 30*b*.

Figure 8A:
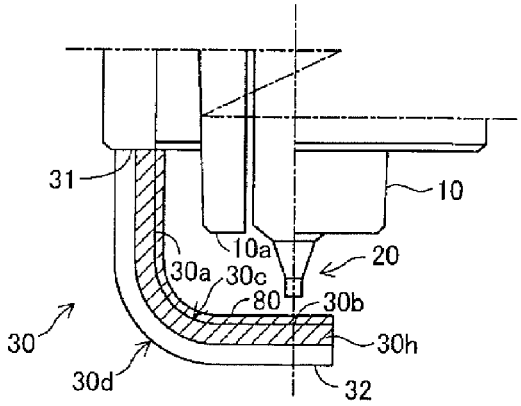
FIGS. 8A and 8B show an enlarged partially sectional elevation view and an enlarged right-side view of a front end part of a spark plug according to a first application example of the present embodiment.
Figure 8B:
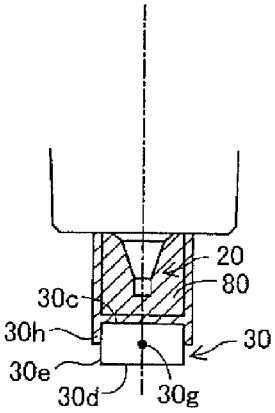
Figure 9A:
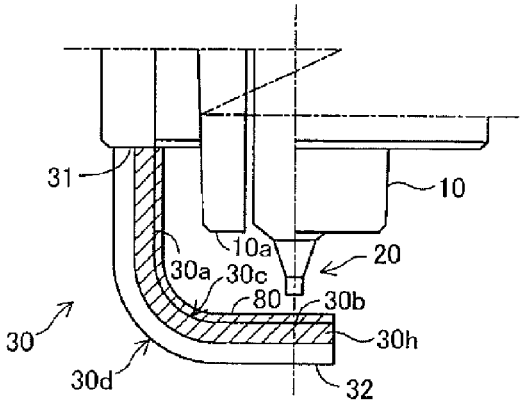
FIGS. 9A and 9B show an enlarged partially sectional elevation view and an enlarged right-side view of a front end part of a spark plug according to a second application example of the present embodiment.
Figure 9B:
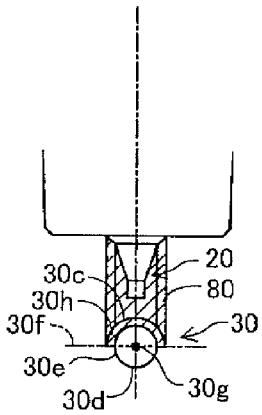

Application examples of the spark plug 100 other than those used as Experimental Examples 1 to 4 in the first verification experiment are shown in FIGS. 8 to 10. FIGS. 8A and 8B show an enlarged partially sectional elevation view and an enlarged right-side view of the front end part of the spark plug according to the first application example of the present embodiment. FIGS. 9A and 9B show an enlarged partially sectional elevation view and an enlarged right-side view of the front end part of the spark plug according to the second application example of the present embodiment.

The arrangement configuration of the coating part 80 in the first application example is different from that in Experiment Example 1, in that the coating part 80 is not formed on a lower-side region (outer surface 30*d* side region) of the side surface 30*e*. It is apparent from the results of the first verification experiment that, even when the coating part 80 is not formed on the side surface 30*e*, it is possible to suppress wear of the ground electrode base material caused by exposure to blowing of sparks. Thus, the arrangement configuration in which the coating part 80 is not formed on the region of the side surface 30*e* from the lower side (i.e. the intersection of the outer surface 30*d* and the side surface 30*c*) to an arbitrary point is included in the present embodiment.

The second application example is the same as the first application example, except that the ground electrode 30 has a cylindrical column shape in the second application example. In the case where the ground electrode 30 is circular in cross section, the inner surface 30*c* and the outer surface 30*d* can be defined as mentioned above. More specifically, the inner surface 30*c* refers to a surface closer to the center electrode than an imaginary line 30*f* that passes through a geometrical center 30*g* of gravity of the end face of the ground electrode 30 when visually observed from the side of the free end portion 32 and extends through the outer surface 30*d* in parallel with the inner surface 30*c*; and the outer surface 30*d* refers to a surface opposite the inner surface 30*c*. The coating part 80 is formed on the above-defined inner surface 30*c*. For increase in strength, the coating part 80 may be formed of a platinum alloy instead of 100% platinum (Pt). The term "thickness" may refer to a thickness of the coating part 80 at a given position or an average thickness of the coating part 80.

Second Verification Experiment

It has been verified by the first verification experiment that it is possible to reduce or prevent wear of the ground electrode base material by forming the coating part 80 of noble metal or noble metal alloy on the ground electrode. On the other hand, it is known that noble metal such as platinum (Pt) or noble metal alloy shows a catalytic activity with increase in temperature and thereby ignites air-fuel mixture without spark ignition. There thus arises a problem that the formation of the coating part 80 on the ground electrode 80 may cause unintended self-ignition (abnormal combustion), which interferes with combustion control. Hence, the second verification experiment is intended to verify the arrangement configuration of the coating part 80 on the ground electrode 30 from the viewpoint of suppressing or preventing the occurrence of abnormal combustion while suppressing or preventing wear of the base material of the ground electrode 30.

Figure 10A:
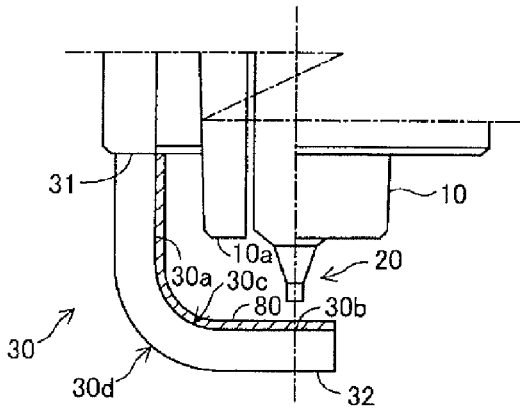
FIGS. 10A and 10B show an enlarged partially sectional elevation view and an enlarged right-side view of a front end part of a spark plug according to Experimental Example 5 of the present embodiment.
Figure 10B:
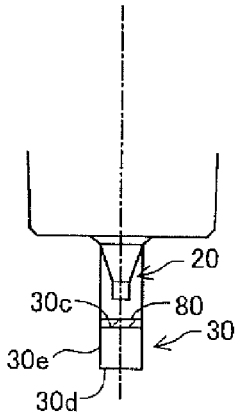
Figure 11A:
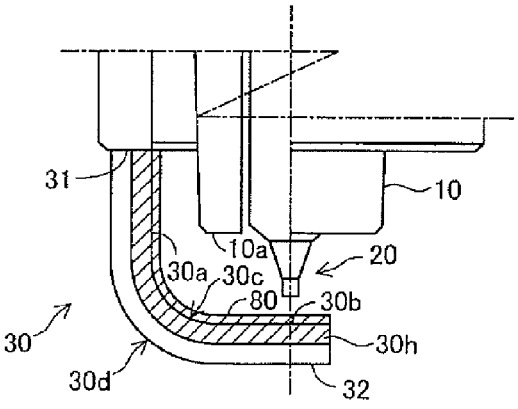
FIGS. 11A and 11B show an enlarged partially sectional elevation view and an enlarged right-side view of a front end part of a spark plug according to Experimental Example 6 of the present embodiment.
Figure 11B:
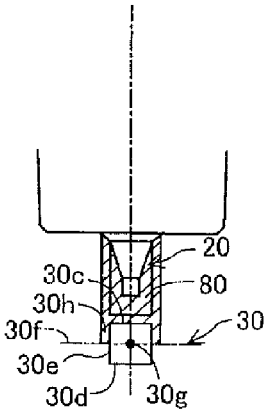
Figure 12A:
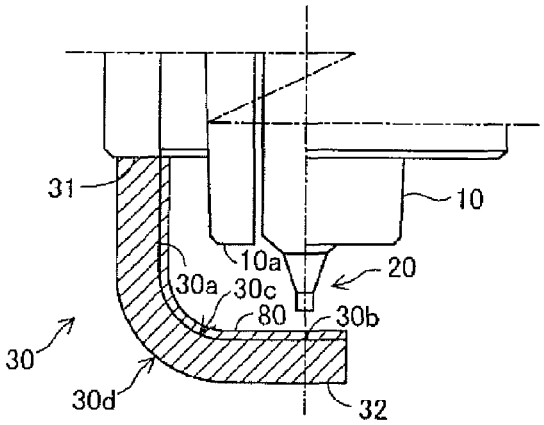
FIGS. 12A and 12B show an enlarged partially sectional elevation view and an enlarged right-side view of a front end part of a spark plug according to Experimental Example 7 of the present embodiment.
Figure 12B:
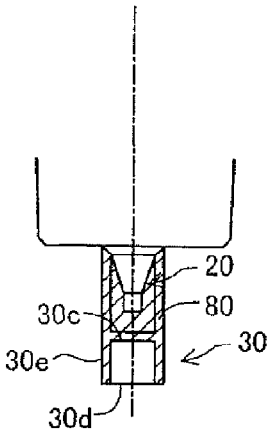
Figure 13A:
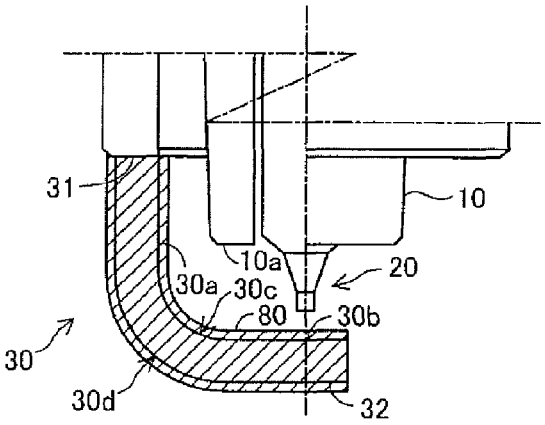
FIGS. 13A and 13B show an enlarged partially sectional elevation view and an enlarged right-side view of a front end part of a spark plug according to Experimental Example 8 of the present embodiment.
Figure 13B:
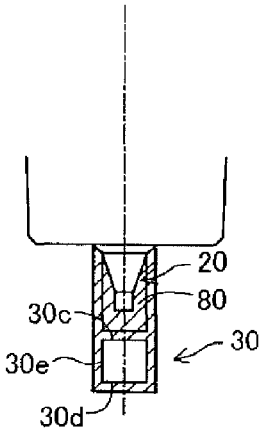

FIGS. 10A and 10B show an enlarged partially sectional elevation view and an enlarged right-side view of the front end part of the spark plug according to Experimental Example 5 of the present embodiment. FIGS. 11A and 11B show an enlarged partially sectional elevation view and an enlarged right-side view of the front end part of the spark plug according to Experimental Example 6 of the present embodiment. FIGS. 12A and 12B show an enlarged partially sectional elevation view and an enlarged right-side view of the front end part of the spark plug according to Experimental Example 7 of the present embodiment. FIGS. 13A and 13B show an enlarged partially sectional elevation view and an enlarged right-side view of the front end part of the spark plug according to Experimental Example 8 of the present embodiment.

The basic structure of the ground electrode 30 used in the second verification experiment is the same as that of Comparative Example shown in FIGS. 2A and 2B, but is different from that of the ground electrode 30 used in the first verification experiment in that the ground electrode 30 is made smaller in width in the second verification experiment for easy check of abnormal combustion. Namely, the ground electrode 30 has: an inner surface 30*c* formed facing the center electrode 20 and the insulator 10; and an outer surface 30*d* formed as all surface except the inner surface 30*c*. The outer surface 30*d* can be defined as a surface connecting one end (side) to the other end (side) of the inner surface 30*c* in the width direction. In the case where the ground electrode 30 is rectangular in cross section, both of an outer surface 30*d* corresponding to a back surface opposite the inner surface 30*c* and a side surface 30*e* connecting the inner surface 30*c* and the outer surface 30*d* are included in the outer surface 30*d*.

In Experimental Example 5, the coating part 80 is formed on the ground electrode 30 of the spark plug 100 so as to cover only the inner surface 30*c* from the fixed end portion 31 to the edge of the free end portion 32 and not cover both of the outer surface 30*d* as the back surface opposite the inner surface 30*c* and the side surface 30*e*. In Experimental Example 6, the coating part 80 is formed on the ground electrode 30 of the spark plug 100 so as to cover the whole of the inner surface 30*c* and further cover a region other than the lower-side region of the outer surface 30*d* (side surface 30*e*), and more specifically, a region 30*h* of the outer surface 30*d* (side surface 30*e*) continuing to the inner surface 30*c*. The region 30*h* of the outer surface 30*d* continuing to the inner surface 30*c* refers to a surface region closer to the inner surface 30*c* than an imaginary line 30*f* that passes through the outer surface 30*d* from a geometrical center 30*g* of gravity of the end face of the ground electrode 30 when visually observed from the side of the free end portion 32 and extends in parallel with the inner surface 30*c*. In the case where the shape of the end face of the ground electrode 30 is linearly symmetrical with respect to the imaginary line 30*f*, the continuing region 30*h* refers to a region of the side surface 30*e* situated over half of the side surface length (i.e. the thickness of the ground electrode 30) from the inner surface 30*c*. In Experimental Example 7, the coating part 80 is formed on the ground electrode 30 of the ground electrode 100 so as to cover the surface of the ground electrode 30 from the fixed end portion 31 to the edge of the free end portion 32, except the outer surface 30*d* as the back surface opposite the inner surface 30*c*. In Experimental Example 8, the coating part 80 is formed on the ground electrode 30 of the ground electrode 100 so as to cover the whole surface of the ground electrode 30 except the end face of the free end portion 32.

It is feasible to form the coating part 80 on the ground electrode 30 by various techniques mentioned above in the first verification experiment.

For the second verification experiment, spark plug samples of Experimental Examples 5 to 8 were each prepared with a heat value of 9 by forming the coating part 80 on the ground electrode 30 as explained above. In each sample, the metal shell was of M12HEX14 type (i.e. the diameter of the mounting thread portion was 12 mm; and the size of the hexagonal portion was 14 mm); the electrode tip of iridium (Ir) with a diameter of 0.6 mm was joined to the front end of the center electrode; the spark gap SG was set to 1.1 mm; the ground electrode 30 was 1 mm square; and the coating part 80 was formed of platinum (Pt) with a thickness of 0.4 mm on the ground electrode 30. Each of the spark plug samples was mounted to a four-cycle gasoline engine, and then, tested for the occurrence or non-occurrence of abnormal combustion at three ignition timings of 53°BTDC, 55°BTDC and 57°BTDC by operating the engine under the conditions of WOT (full load, full throttle) and 6000 rpm. The occurrence or non-occurrence of abnormal combustion can be checked by visual inspection using a combustion monitor, which indicates combustion inside the cylinder in visual form, or by comparison of normal combustion timing and combustion timing based on measurement of pressure inside the cylinder. In the second verification experiment, the narrow ground electrode 30 was used to easily check the abnormal combustion suppression/prevention effects according to difference in the arrangement configuration of the coating part 80. Further, the spark plug sample was provided with a heat value of 9, that is, provided as a cold-type spark plug to prevent the occurrence of abnormal combustion from the insulator 10.

The evaluation results are shown in TABLE 2. In TABLE 2, "G" indicates the non-occurrence of abnormal combustion; and "P" indicates the occurrence of abnormal combustion.

TABLE 2

| | Ignition Timing (°BTDC) | | |
|---|---|---|---|
| | 53 | 55 | 57 |
| Comparative Example 1 | G | G | G |
| Experimental Example 5 | G | G | G |
| Experimental Example 6 | G | G | G |
| Experimental Example 7 | G | P | P |
| Experimental Example 8 | P | P | P |

There was observed no abnormal combustion at all of three ignition timings in the sample of Comparative Example where no coating part 80 was formed on the ground electrode 30, in the sample of Experimental Example 5 where the coating part 80 was formed only on the inner surface 30*c* and in the sample of Experimental Example 6 where the coating part 80 was formed on the inner surface 30*c* and the region 30*h* of the outer surface 30*d* continuing to the inner surface 30*c*. On the other hand, there was observed abnormal combustion at ignition timings of 55°BTDC and 57°BTDC in the sample of Experimental Example 7 where the coating part 80 was formed on the surface of the ground electrode 30 from the fixed end portion 31 to the edge of the free end portion 32, except the outer surface 30*d*. There was observed abnormal combustion at all of three ignition timings of 53°BTDC, 55°BTDC and 57°BTDC in the sample of Experimental Example 8 where the coating part 80 was formed on the whole surface of the ground electrode 30 from the fixed end portion 31 to the edge of the free end portion 32, except the end face of the free end portion 32. The temperature inside the combustion chamber increases as the ignition timing (ignition angle) is more advanced. As a result of such temperature increase in combination with the catalytic effect of the coating part 80, it becomes more likely that abnormal combustion will occur It has been shown by the above results of the second verification experiment that: just by forming the coating part 80 on the ground electrode 30 so as not to cover the region of the outer surface 30*d* corresponding to the back surface opposite the inner surface 30*c*, it is not possible to suppress or prevent abnormal combustion caused due to the formation of the coating part 80; and it is possible to effectively suppress or prevent the occurrence of abnormal combustion, while suppressing or preventing wear of the ground electrode base material, by forming the coating part 80 on the ground electrode 30 so as not to cover the region of the outer surface 30*d* other than the region 30*h* continuing to the inner surface 30*c*. In the case where the ground electrode 30 is rectangular in cross section as in the second verification experiment, it can be said that it is possible to effectively suppress or prevent abnormal combustion by forming the coating part 80 on the ground electrode 30 so as not to cover at least the region 30*h* of the side surface 30*c* continuing to the outer back surface 30*d* opposite from the inner surface 30*c*.

Figure 14A:
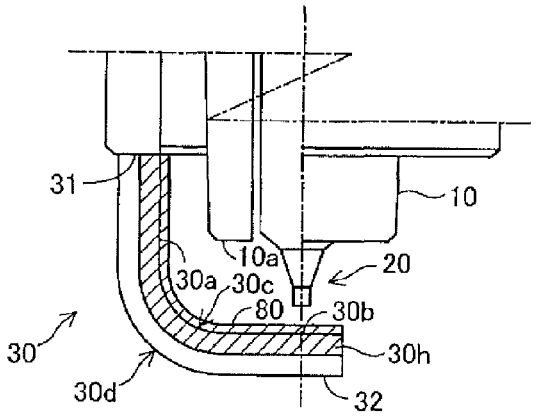
FIGS. 14A and 14B show an enlarged partially sectional elevation view and an enlarged right-side view of a front end part of a spark plug according to a third application example of the present embodiment.
Figure 14B:
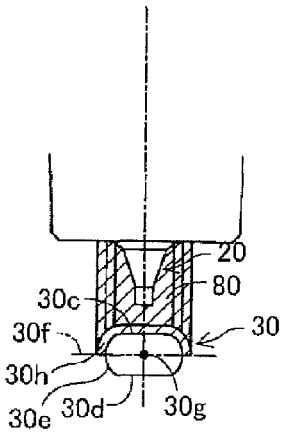
Figure 15A:
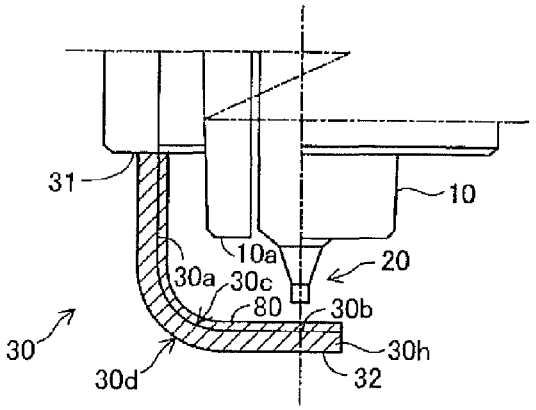
FIGS. 15A and 15B show an enlarged partially sectional elevation view and an enlarged right-side view of a front end part of a spark plug according to a fourth application example of the present invention.
Figure 15B:
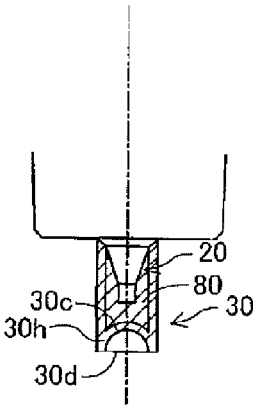

Application examples of the spark plug 100 other than those used as Experimental Examples 5 and 6 in the second verification experiment are shown in FIGS. 14A and 14B and FIGS. 15A and 15B. FIGS. 14A and 14B show an enlarged partially sectional elevation view and an enlarged right-side view of the front end part of the spark plug according to the third application example of the present embodiment. FIGS. 15A and 15B show an enlarged partially sectional elevation view and an enlarged right-side view of the front end part of the spark plug according to the fourth application example of the present invention.

The arrangement configuration of the coating part 80 in the third application example is the same as that in Experimental Example 6, except that the ground electrode 30 has a cross-sectional shape where upper and lower surfaces are connected by curved side surface.

The arrangement configuration of the coating part 80 in the fourth application example is the same as that in Experimental Example 6, except that the ground electrode 30 has a semi-cylindrical (semi-circular) shape.

Third Verification Experiment

It has been verified by the first verification experiment that it is possible to reduce or prevent wear of the ground electrode base material by forming the coating part 80 of noble metal or noble metal alloy on the ground electrode. It has further been verified by the second verification experiment that it is possible to suppress or prevent the occurrence of abnormal combustion, while suppressing or preventing wear of the ground electrode base material, by forming the coating part 80 on the ground electrode 30 so as not to cover the region other than the region 30*h* of the outer surface 30*d* continuing to the inner surface 30*c*. It is generally known that ignition of air-fuel mixture is more likely to occur at an edge or end region than at a surface region. Hence, the third verification experiment is intended to verify the occurrence of unintended self-ignition (abnormal combustion) due to the formation of the coating part 80 on the edge region of the free end portion 32 of the ground electrode 30.

Figure 16A:
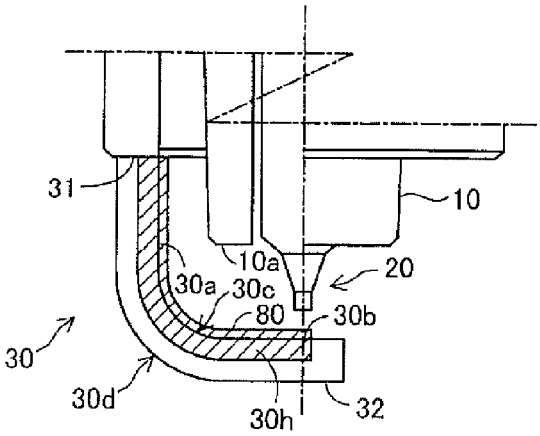
FIGS. 16A and 16B show an enlarged partially sectional elevation view and an enlarged right-side view of a front end part of a spark plug according to Experimental Example 10 of the present embodiment.
Figure 16B:
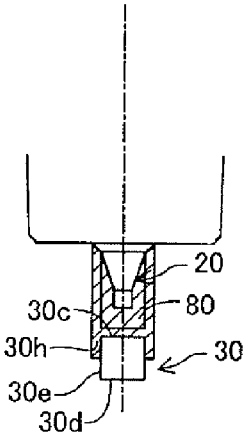

The spark plug according to Experimental Example 9 of the present embodiment is of the same structure as that of the spark plug shown in FIGS. 11A and 11B. FIGS. 16A and 16B show an enlarged partially sectional elevation view and an enlarged right-side view of the front end part of the spark plug according to Experimental Example 10 of the present embodiment.

The basic structure of the ground electrode 30 used in the third verification experiment is the same as that of Experimental Example 6 used in the second verification experiment and shown in FIGS. 11A and 11B.

In Experimental Example 9, the coating part 80 is formed on the ground electrode 30 of the spark plug 100 so as to cover the inner surface 30*c* and the region 30*h* of the outer surface 30*d* continuing to the inner surface 30*c* from the fixed end portion 31 to the edge of the free end portion 32. Namely, the coating part 80 is formed to reach the edge of the free end portion 32 of the ground electrode 30 in Experimental Example 9. In Experimental Example 10, the coating part 80 is formed on the ground electrode 30 of the spark plug 100 so as to cover the region of the inner surface 30*c* and the region of the outer surface 30*d* continuing to the inner surface 30*c* from the fixed end portion 31 to the vicinity of the center electrode-facing site 30*b*. Namely, the coating part 80 is not formed on the edge region of the free end portion 32 of the ground electrode 30 in Experimental Example 10.

It is feasible to form the coating part 80 on the ground electrode 30 by various techniques mentioned above in the first verification experiment.

In the third verification experiment, samples of the spark plug were tested the occurrence or non-occurrence of abnormal combustion under the same conditions as in the second verification experiment, except that three ignition timings were set to 59°BTDC, 61°BTDC and 63°BTDC. The evaluation results are shown in TABLE 3. In TABLE 3, "G" indicates the non-occurrence of abnormal combustion; and "P" indicates the occurrence of abnormal combustion.

TABLE 3

| | Ignition Timing (°BTDC) | | |
|---|---|---|---|
| | 59 | 61 | 63 |
| Experimental Example 9 | G | G | P |
| Experimental Example 10 | G | G | G |

The occurrence of abnormal combustion was observed at 63°BTDC in the sample of Experimental Example 9 where the coating part 80 was formed on the inner surface 30*c* and the region 30*h* of the outer surface 30*d* continuing to the inner surface 30*c* from the fixed end portion 31 to the edge of the free end portion 32. On the other hand, there was observed no abnormal combustion at all of three ignition timings in the sample of Experimental Example 10 where the coating part 80 was formed on the region of the inner surface 30*c* and the region of the outer surface 30*d* continuing to the inner surface 30*c* from the fixed end portion 31 to the vicinity of the center electrode-facing site 30*b*.

It has been shown by the above results of the third verification experiment that, by forming the coating part 80 so as not to cover the edge of the free end portion 32 of the ground electrode 30, it is possible to effectively suppress or prevent abnormal combustion caused due to the formation of the coating part 80.

Figure 17:
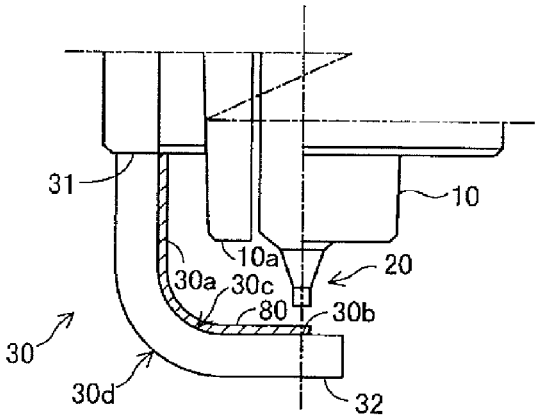
FIG. 17 shows an enlarged partially sectional elevation view of a front end part of a spark plug according to a fifth application example of the present embodiment.
Figure 18:
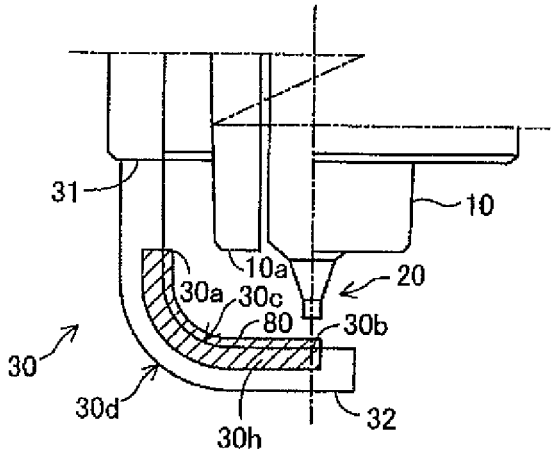
FIG. 18 shows an enlarged partially sectional elevation view of a front end part of a spark plug according to a sixth application example of the present invention.

Application examples of the spark plug 100 other than those used as Experimental Examples 9 and 10 in the third verification experiment are shown in FIGS. 17 and 18. FIG. 17 shows an enlarged partially sectional elevation view and an enlarged right-side view of the front end part of the spark plug according to the fifth application example of the present embodiment. FIG. 18 shows an enlarged partially sectional elevation view and an enlarged right-side view of the front end part of the spark plug according to the sixth application example of the present invention. It is herein noted that the spark plug according to the first application example shown in FIGS. 3A and 3B satisfy the conditions verified by the third verification experiment.

The arrangement configuration of the coating part 80 in the fifth application example is the same as that in Experimental Example 10, except that the coating part 80 is formed only on the region of the inner surface 30*c* from the fixed end portion 31 to the center electrode-facing site 30*b*.

The arrangement configuration of the coating part 80 in the sixth application example is the same as that in Experimental Example 10, except that the coating part 80 is formed only on the region of the inner surface 30*c* from the insulator-facing site 30*a* to the center electrode-facing site 30*b*, that is, not formed on the region of the inner surface 30*c* from the fixed end portion 31 to the insulator-facing site 30*a*.

Fourth Verification Experiment

It has been verified by the first verification experiment that it is possible to reduce or prevent wear of the ground electrode base material by forming the coating part 80 of noble metal or noble metal alloy on the ground electrode. However, the amount of wear of the ground electrode base material is locally increased in the area susceptible to damage by sparks, i.e. the breakdown-susceptible area. Hence, the fourth verification experiment is intended to verify the arrangement configuration of the coating part 80 on the ground electrode 30 form the viewpoint of improving the durability of the ground electrode 30 at the breakdown-susceptible area (discharge starting point).

Figure 19A:
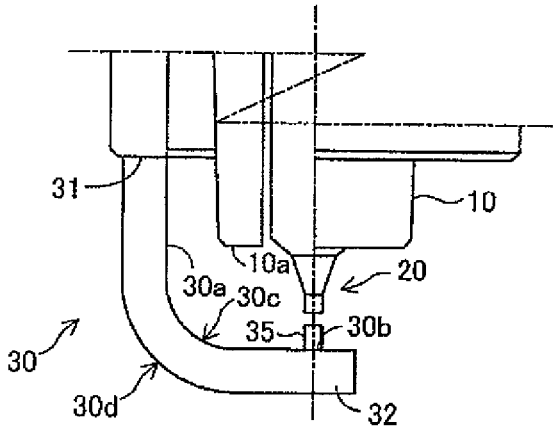
FIGS. 19A and 19B show an enlarged partially sectional elevation view and an enlarged right-side view of a front end part of a spark plug according to Experimental Example 11 of the present embodiment.
Figure 19B:
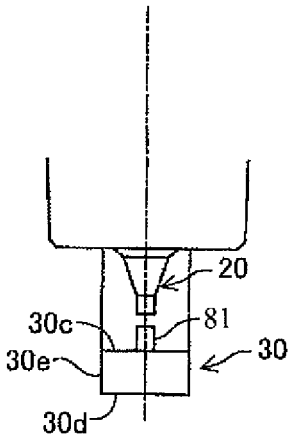
Figure 20A:
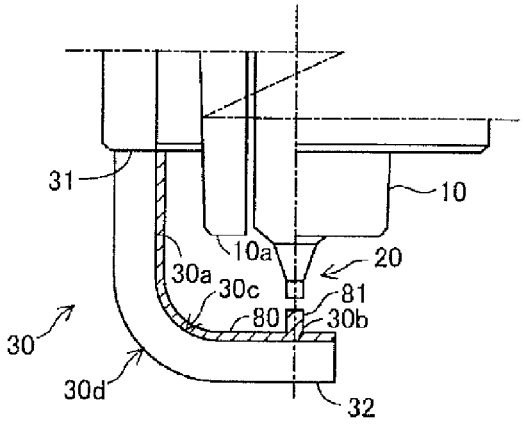
FIGS. 20A and 20B show an enlarged partially sectional elevation view and an enlarged right-side view of a front end part of a spark plug according to Experimental Example 13 of the present embodiment.
Figure 20B:
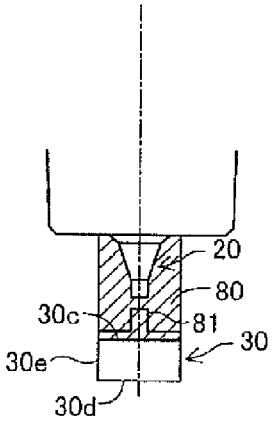

FIGS. 19A and 19B show an enlarged partially sectional elevation view and an enlarged right-side view of the front end part of the spark plug according to Experimental Example 11 of the present embodiment. The spark plug according to Experimental Example 12 of the present embodiment is of the same structure as that of the spark plug shown in FIGS. 4A and 4B. FIGS. 20A and 20B show an enlarged partially sectional elevation view and an enlarged right-side view of the front end part of the spark plug according to Experimental Example 13 of the present embodiment.

The basic structure of the ground electrode 30 used in the fourth verification experiment is the same as that of Comparative Example shown in FIGS. 2A and 2B.

In Experimental Example 11, a noble metal tip is provided as a protruding part 81 on the center electrode-facing site 30*b* of the ground electrode 30 of the spark plug 100; and no coating part 80 was formed. The noble metal tip provided as the protruding part 81 is a tip of 100% platinum (Pt) with a diameter of 0.7 mm and a thickness of 1 mm. This metal tip (protruding part 81) can be joined to the ground electrode 30 or the coating part 80 by e.g. laser welding. In Experimental Example 12, the coating part 80 is formed with a thickness of 100 μm on the ground electrode 30 of the spark plug 100 so as to cover the inner surface 30*c* from the fixed end portion 31 to the edge of the free end portion 32. In Experimental Example 13, the coating part 80 is formed on the ground electrode 30 of the spark plug 100 so as to cover the surface of the ground electrode 30 from the fixed end portion 31 to the edge of the free end portion 32, except the outer surface 30*d* as the back surface opposite the inner surface 30*c*; and a noble metal tip is provided as a protruding part 81 on the center electrode-facing site 30*b*. The noble metal tip provided as the protruding part 81 is a tip of 100% platinum (Pt) with a diameter of 0.7 mm and a thickness of 1 mm. This protruding part 81 on the coating part 80 is to increase the thickness of the coating part 81 at the area in which breakdown of the ground electrode 30 tends to occur It is feasible to form the coating part 80 on the ground electrode 30 by various techniques mentioned above in the first verification experiment.

In the fourth verification experiment, spark plug samples of Experimental Examples 11 to 13 were each prepared by providing the coating part 80 or the protruding part 81, or both of the coating part 80 and the protruding part 81, on the ground electrode 30 as explained above. In each sample, the metal shell was of M12HEX14 type (i.e. the diameter of the mounting thread portion was 12 mm; and the size of the hexagonal portion was 14 mm); the electrode tip of iridium (Jr) with a diameter of 0.6 mm was joined to the front end of the center electrode; and the spark gap SG was set to 1.1 mm. A durability test was performed on each of the spark plug samples by mounting the sample plug to a four-cycle gasoline engine and operating the engine under the conditions of a load of −10 kPa, an A/F ratio of 12.0 and an endurance time of 200 hours. The volume of wear of the base material of the ground electrode 30 caused during the test was then evaluated. Herein, the test conditions of this verification experiment are equivalent to the conditions of vehicle driving at a speed of 20 km an hour. The evaluation of the wear volume was made in the same manner as in the first verification experiment.

Figure 21:
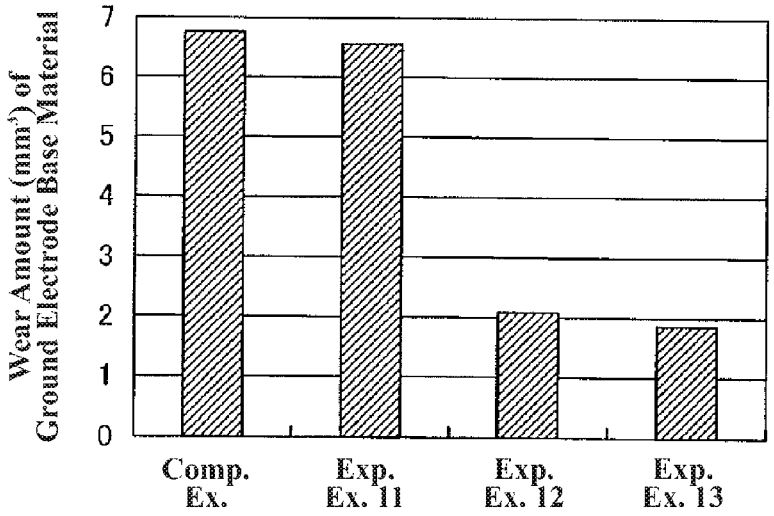
FIG. 21 shows a graph illustrating the amounts of wear of ground electrode base materials as used for Comparative Example and Experimental Examples in a fourth verification experiment.

The evaluation results are shown in TABLE 4 and FIG. 21. FIG. 21 shows a graph showing the amounts of wear of the ground electrode base materials used for Comparative Example and Experimental Examples in the fourth verification experiment.

TABLE 4

| | Volume ($mm^3$) of Wear of Ground Electrode Base Material After 200 Hours |
|---|---|
| Experimental Example 11 | 6.8 |
| Experimental Example 12 | 6.6 |
| Experimental Example 13 | 2.1 |
| Experimental Example 14 | 1.9 |

In the sample of Comparative Example where no coating part 80 was provided on the ground electrode 30 and the sample of Experimental Example 11 where only the protruding part 81 was provided on the ground electrode 30, the volumes of wear of the ground electrode base materials were respectively 6.8 and 6.6 $mm^3$. On the other hand, the volumes of wear of the ground electrode base materials were respectively 2.1 and 1.9 $mm^3$ in the sample of Experimental Example 12 where the coating part 80 was provided and the sample of Experimental Example 13 where both of the coating part 80 and the protruding part 81 were provided. The wear volume of the ground electrode base material was suppressed to approximately 2 $mm^3$ or less by the formation of the coating part 80.

It has been shown by the above results of the fourth verification experiment that it is not possible to suppress wear of the ground electrode base material just by providing the protruding part 81 on the ground electrode. In the case of the ground electrode 30 being provided with the protruding part 81, the technical effects of the coating part 80 have also been confirmed. It has further been shown that, in the case of the coating part 80 being formed on the ground electrode 30, it is possible to effectively suppress wear of the ground electrode base material by providing the protruding part 81 on the ground electrode 30.

Figure 22A:
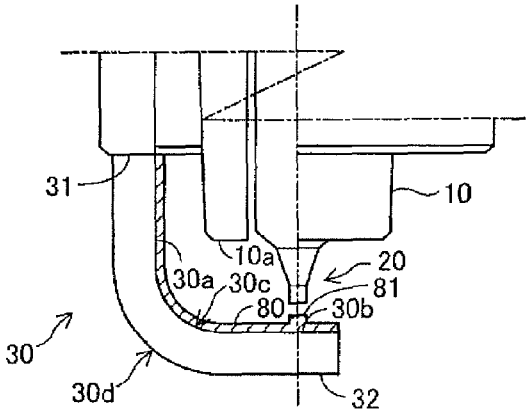
FIGS. 22A and 22B show an enlarged partially sectional elevation view and an enlarged right-side view of a front end part of a spark plug according to a seventh application example of the present embodiment.
Figure 22B:
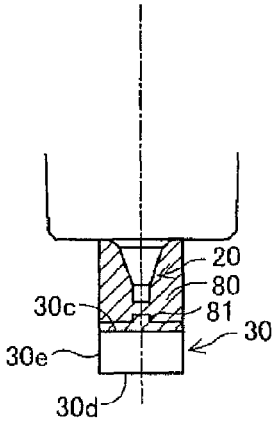
Figure 23A:
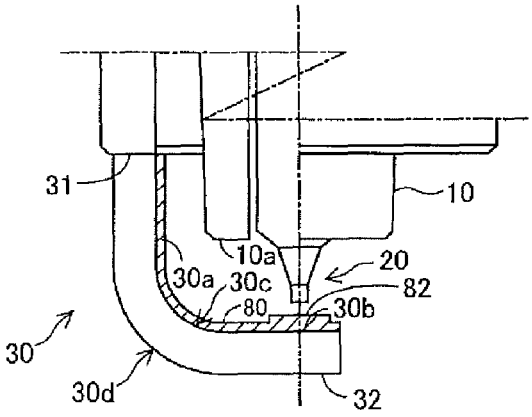
FIGS. 23A and 23B show an enlarged partially sectional elevation view and an enlarged right-side view of a front end part of a spark plug according to an eighth application example of the present invention.
Figure 23B:
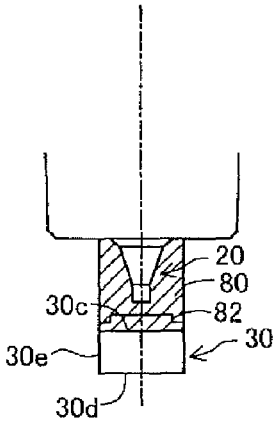

Application examples of the spark plug 100 other than that used as Experimental Example 13 in the fourth verification experiment are shown in FIGS. 22A and 22B and FIGS. 23A and 23B. FIGS. 22A and 22B show an enlarged partially sectional elevation view and an enlarged right-side view of the front end part of the spark plug according to the seventh application example of the present embodiment. FIGS. 23A and 23B show an enlarged partially sectional elevation view and an enlarged right-side view of the front end part of the spark plug according to the eighth application example of the present invention.

The structure of the ground electrode 30 in the seventh application example is the same as that of Experimental Example 13, except that the protruding part 81 is made smaller in thickness in the seventh application example.

The structure of the ground electrode in the eighth application example is the same as that of Experimental Example 13, except that a layer part 82 is additionally provided instead of the protruding part 81, so as to form the coating part 80 with a multi-layer structure and thereby increase the thickness of the coating part 80 at the breakdown-susceptible area.

Figure 24:
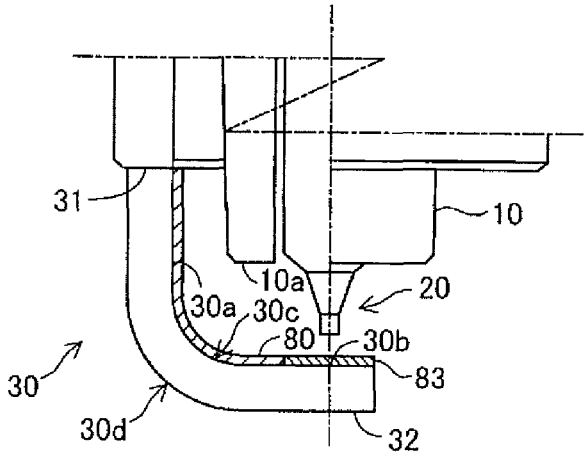
FIG. 24 shows an enlarged partially sectional elevation view of a front end part of a modification example of the spark plug as used in the fourth verification experiment.

A modification example of the spark plug used in the fourth verification experiment is shown in FIG. 24. FIG. 24 shows an enlarged partially sectional elevation view and an enlarged right-side view of the front end part of the spark plug, as used in the fourth verification experiment, according to the modification example of the present embodiment. In this modification example, a second coating part 83 of higher wear-resistant noble metal material is formed a portion of the coating part 80 in the breakdown-susceptible area so as to effectively suppress or prevent wear of the ground electrode base material. For example, even though the amount of wear of the base material in the bent or curved portion of the ground electrode 30 is 3.0 $mm^3$, the amount of wear of the base material at the breakdown-susceptible area of the ground electrode 30 becomes 6.0 $mm^3$ or more. The higher wear-resistant noble metal material is available by e.g. using noble metal alloy as the material of the coating part 80 and using higher-purity noble metal alloy or pure noble metal as the material of the second coating part 83. It is costly to form the whole of the coating part 80 from pure noble metal. It is thus possible to achieve both of suppression of wear of the electrode base material and cost reduction by forming the coating part 80 from low-purity noble metal alloy and forming the second coating part 83 from high-purity noble metal alloy or pure noble metal.

The same results as those of the fourth verification experiment can be obtained in both of the case where the coating part 81 is first formed, followed by providing the protruding part 81 on the coating part 80, and the case where the protruding part 81 is first provided, followed by forming the coating part 80 on the protruding part 81.

Fifth Verification Experiment

The firth verification experiment is intended to verify the relationship between the thickness of the coating part and the amount of wear of the ground electrode base material and the relationship between the thickness of the coating part and the adhesion of the coating part to the ground electrode. The arrangement configuration of the coating part in this verification experiment is the same as that of Experimental Example 3.

Figure 25:
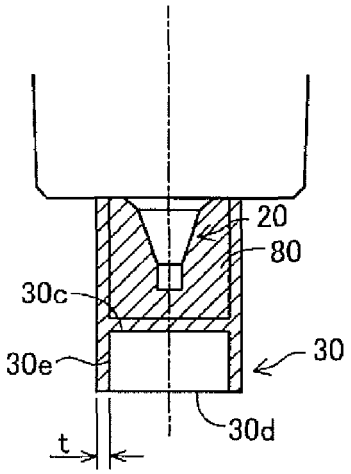
FIG. 25 shows an enlarged right-side view of a front end part of a spark plug with a coating part formed on a ground electrode in a fifth verification experiment.

FIG. 25 shows an enlarged partially elevation view and an enlarged right-side view of the front end part of the spark plug with the coating part formed on the ground electrode in the fifth verification experiment.

The basic structure of the ground electrode 30 used in the fifth verification experiment is as shown in FIG. 25. The ground electrode 30 has: an inner surface 30*c* formed facing the center electrode 20 and the insulator 10; and an outer surface 30*d* formed as all surface except the inner surface 30*c*. In the fifth verification experiment, the ground electrode 30 is rectangular in cross section. Thus, both of an outer surface 30*d* corresponding to a back surface opposite the inner surface 30*c* and a side surface 30*e* connecting the inner surface 30*c* and the outer surface 30*d* are included in the outer surface 30*d*. The coating part 80 is formed on the whole surface of the ground electrode, except the outer surface 30*d* as the back surface opposite the inner surface 30*c*.

For the verification about the relationship between the thickness of the coating part and the amount of wear of the ground electrode base material in the fifth verification experiment, seven kinds of samples of the spark plug were each prepared by setting the thickness t of the coating part 80 to 1 μm, 3 μm, 50 μm, 100 μm, 200 μm, 400 μm or 500 μm. The coating part 80 was formed on the ground electrode 30 in the same manner as mentioned above in the first verification experiment.

In the spark plug samples for the verification about the relationship between the thickness of the coating part and the amount of wear of the ground electrode base material in the fifth verification experiment, the metal shell was of M12HEX14 type (i.e. the diameter of the mounting thread portion was 12 mm; and the size of the hexagonal portion was 14 mm); the electrode tip of iridium (Jr) with a diameter of 0.6 mm was joined to the front end of the center electrode; the spark gap SG was set to 1.1 mm; and the coating part 80 was formed with a thickness t of 1 μm, 3 μm, 50 μm, 100 μm, 200 μm, 400 μm or 500 μm on the ground electrode 30. Each of the spark plug samples were tested under the same conditions as in the fourth verification experiment. The volume of wear in each sample was evaluated in the same manner as in the first verification experiment.

Figure 26:
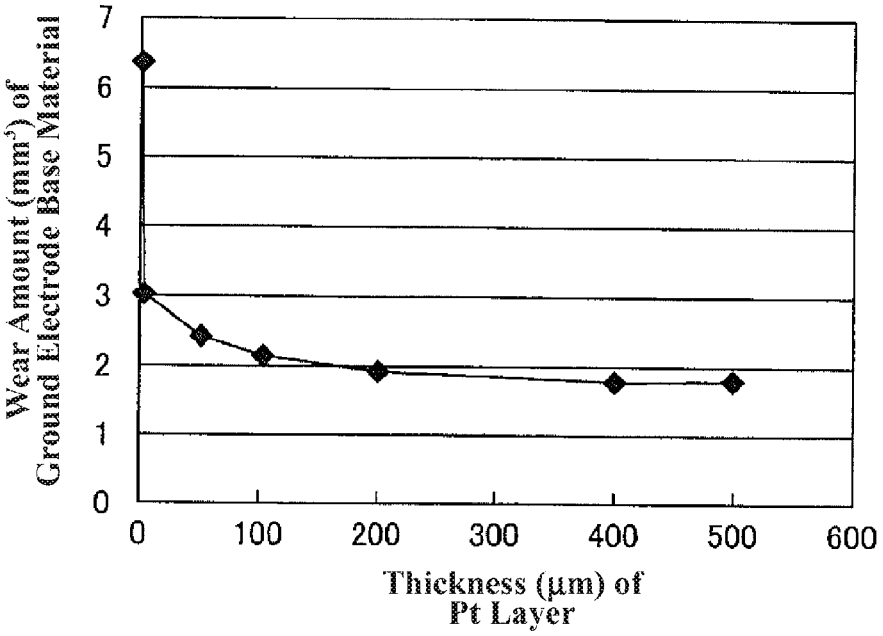
FIG. 26 shows a graph illustrating the amount of wear of ground electrode base material, with respect to different thicknesses of the coating part, as used in the fifth verification experiment.

The evaluation results are shown in TABLE 5 and FIG. 26. TABLE 5 shows amount of wear of the ground electrode base material, with respect to different thicknesses of the coating part, in the fifth verification experiment. FIG. 26 shows a graph illustrating the amount of wear of the ground electrode base material, with respect to different thicknesses of the coating part, in the fifth verification experiment.

TABLE 5

| Thickness ($mm^3$) | Volume ($mm^3$) of Wear of Ground Electrode Base Material After 200 Hours |
|---|---|
| 1 | 6.4 |
| 3 | 3.0 |
| 50 | 2.4 |
| 100 | 2.1 |
| 200 | 1.9 |
| 400 | 1.8 |
| 500 | 1.8 |

As is seen from the verification results, the wear volume was 6.4 $mm^3$ when the thickness t of the coating part 80 was 1 μm; the wear volume was 3.0 $mm^3$ when the thickness t of the coating part 80 was 3 μm; the wear volume was 2.4 $mm^3$ when the thickness t of the coating part 80 was 50 μm; the wear volume was 2.1 $mm^3$ when the thickness t of the coating part 80 was 100 μm; the wear volume was 1.9 $mm^3$ when the thickness t of the coating part 80 was 200 μm; the wear volume was 1.8 $mm^3$ when the thickness t of the coating part 80 was 400 μm; and the wear volume was 1.8 $mm^3$ when the thickness t of the coating part 80 was 500 μm. As is seen from FIG. 26, the wear volume of the ground electrode base material was significantly decreased when the thickness t of the coating part 80 exceeded 3 μm. It is thus preferable that the thickness t of the coating part 80 is 3 μm or larger. On the other hand, there was no remarkable change in the wear volume of the ground electrode base material when the thickness t of the coating part 80 exceeded 400 μm. It suffices that the thickness t of the coating part 80 is 400 μm or smaller. In summary, it is possible to effectively suppress wear of the ground electrode base material when the thickness t of the coating part 80 is in the range of 3 μm to 400 μm.

For the verification about the relationship between the thickness t of the coating part and the adhesion of the coating part in the fifth verification experiment, samples of the spark plug were each prepared by thermal spraying a coating of platinum (Pt) with a thickness of 1 μm, 3 μm, 50 μm, 100 μm, 200 μm, 400 μm or 500 μm onto the ground electrode 30 in the same manner as those for the verification about the relationship between the thickness t of the coating part and the amount of wear of the ground electrode base material. A diffusion treatment was performed on each of the spark plug samples for 10 hours at 800° C. Then, the resulting sample was subjected to heating/cooling test and observed with a microscope. In the occurrence of cracking in the coating part 80, the adhesion of the coating part 80 was evaluated as poor. In the non-occurrence of cracking in the coating part 80, the adhesion of the coating part 80 was evaluated as good. The heating/cooling test was conducted by repeating 1000 cycles of heating for 2 minutes at maximum 1050° C. and cooling for 1 minute.

The evaluation results are shown in TABLE 6. TABLE 6 shows the evaluation results about the adhesion of the coating part to the ground electrode base material, with respect to different thicknesses t of the coating part, in the fifth verification experiment. In TABLE 6, "Y" indicates the occurrence of cracking in the coating part 80; and "N" indicates the non-occurrence of cracking in the coating part 80.

TABLE 6

| Thickness ($mm^3$) | Occurrence of Cracking |
|---|---|
| 1 | N |
| 3 | N |
| 50 | N |
| 100 | N |
| 200 | N |
| 400 | N |
| 500 | Y |

As shown in FIGS. 6A and 6B, the occurrence of cracking in the coating part 80 was observed when the thickness t of the coating part 80 was 500 μm. It is thus preferable that the thickness t of the coating part 80 is smaller than 500 μm, more preferably 400 μm or smaller, in view of the adhesion of the coating part 80 to the ground electrode base material. It is herein assumed that cracking occurs in the coating part 80 due to difference in thermal expansion or thermal shrinkage between the ground electrode base material and the coating part 80. In other words, when the coating part becomes larger in thickness, the coating part does not thermally expand or shrink in response to thermal expansion or shrinkage of the ground electrode base material so that cracking occurs in the coating part 80. The occurrence of cracking in the coating part 80 can be judged as meaning low (poor) adhesion of the coating part 80 to the ground electrode base material.

It has shown by the above results of the fifth verification experiment that the thickness t of the coating part 80 is preferably in the range of 3 μm to 400 μm in view of the relationships between the wear amount of the ground electrode base material, the adhesion of the coating part 80 to the ground electrode base material and the thickness t of the coating part 80.

Sixth Verification Experiment

Figure 27:
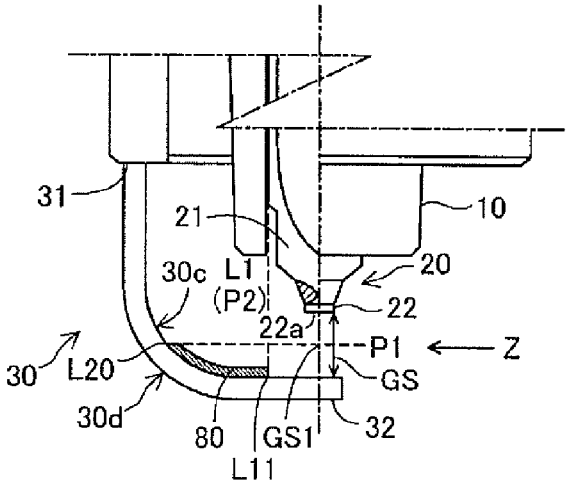
FIG. 27 shows an enlarged partially sectional elevation view of a front end part of a spark plug according to Experimental Example 14 of the present embodiment as used in a sixth verification experiment.
Figure 28:
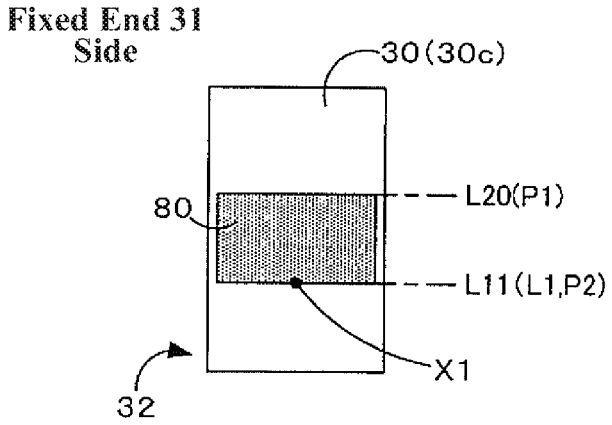
FIG. 28 shows an enlarged plan view of the front end part of the spark plug according to Experimental Example 14 of the present embodiment.
Figure 29:
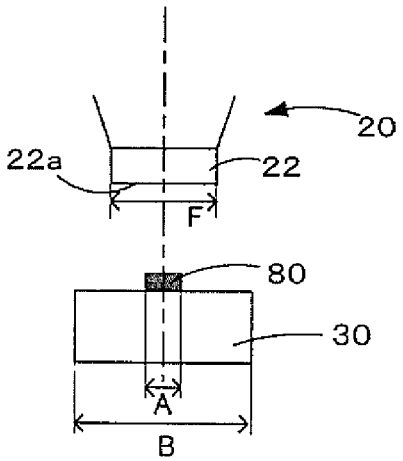
FIG. 29 shows a perspective view of the spark plug as viewed in a direction of arrow Z of FIG. 27.
Figure 30:
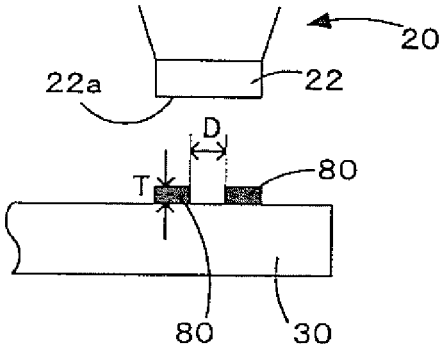
FIG. 30 shows a schematic view explaining a definition example of a coating part on a ground electrode base material in the spark plug according to the present embodiment.

The sixth verification experiment is intended to further verify the arrangement configuration of the coating part 80 on the ground electrode 30 from the viewpoint of suppressing and preventing wear of the base material of the ground electrode 30. The spark plug used herein as Comparative Example is of the type where no coating is formed on the ground electrode as shown in FIGS. 2A and 2B. FIG. 27 shows an enlarged partially sectional elevation view of the front end part of the spark plug according to Experimental Example 14 of the present embodiment as used in the sixth verification experiment. FIG. 28 shows an enlarged plan view of the front end part of the spark plug according to Experimental Example 14 of the present embodiment. FIG. 29 shows a perspective view of the spark plug as viewed in a direction of arrow Z of FIG. 27. FIG. 30 shows a schematic view explaining the definition of the coating part on the ground electrode base material in the spark plug according the present embodiment.

The basic structure of the ground electrode 30 used in the sixth verification experiment is the same as that of Comparative Example shown in FIGS. 2A and 2B. The ground electrode 30 has: an inner surface 30*c* formed facing the center electrode 20 and the insulator 10; and an outer surface 30*d* formed as all surface except the inner surface 30*c*.

In Experimental Example 14, the coating part 80 is formed on the ground electrode 30 of the spark plug 100 so as to cover a region of the inner surface 30*c* from a first intersection L11 to a second intersection L20, where the first intersection L11 is defined as containing an intersection point X1 at which an imaginary line L1 extending from an outer circumference of the center electrode base material 21 at a side of the fixed end portion 31 to the ground electrode 30 intersects the ground electrode 30; and the second intersection 20 is defined as an intersection at which an imaginary plane P1 passing through a midpoint SG1 of the spark gap SG and extending in parallel with the end face of the front end 22 of the electrode tip 22 (i.e. the end face of the front end portion of the center electrode 20) intersects the ground electrode 30 as shown in FIGS. 27 and 28. The first intersection L11 may be defined as an intersection at which an imaginary plane P2 containing the imaginary line L1, passing tangent to the outer circumference of the center electrode base material 21 and extending to the ground electrode 30 intersects the ground electrode 30, or defined as an intersection at which a tangent plane passing tangent to the outer circumference of the center electrode base material 21 at the side closest to the fixed end portion 31 and extending in parallel with the center axis of the center electrode 20 intersects the ground electrode 30, rather than defined as the intersection of the imaginary line L1 and the ground electrode.

In Experimental Example 14, the spark plug is so configured as to satisfy the relationship of $0.7\ F \leq A \leq B$, where A is the dimension of the coating part 80 in the width direction; B is the dimension of the ground electrode 30 in the width direction; and F is the width of the front end (front end face) 22*a* of the electrode tip 22 as shown in FIG. 29. Further, the spark plug is so configured that, when the ground electrode 30, the coating part 80 and the electrode tip 22 are visually observed from the end face side of the free end portion 32 of the ground electrode 30, a center line of the coating part 80 perpendicular to the width direction is in a range of the width of the electrode tip 22. Herein, the center of the coating part 80 and the center of the front end 22*a* of the electrode tip 22 each refers to a geometrical center; the width direction refers to, when the ground electrode 30 is viewed from the end face side of the free end portion 32, a direction parallel with the end face of the front end 22*a* of the electrode tip 22; and the width of the front end 22*a* refers to a dimension of the front end 22*a* in a direction parallel with the inner surface 30*c* of the ground electrode 30. The above width-direction dimension relationship may be alternatively be defined as follows: when the center of the coating part 80 and the center of the front end 22*a* of the electrode tip 22 are projected onto a plane parallel with the width direction of the ground electrode 30, a horizontal distance between those two projected center points is half or less of the dimension of the coating part 80 in the width direction; or, when a straight line indicating a horizontal distance between the center of the coating part 80 and the center of the front end 22*a* of the electrode tip 22 is projected onto a plane parallel with the end face of the free end portion 32, the projected straight line is half or less of the dimension of the coating part 80 in the width direction. In Experimental Example 14, the width of the front end 22 corresponds to a diameter because the electrode tip 22 has a cylindrical column shape.

The coating part 80 is not necessarily in the form of a single continuous layer and may be in the form of a plurality of separate layers arranged to satisfy the relationship of: (1) $T \geq D$ in the case of $T \geq 0.2$ mm; and (2) $D \leq 0.2$ mm in the case of $T < 0.2$ mm where T is the thickness of the coating part 80; and D is the distance between the separate coating layers 80 as shown in FIG. 30. The configuration in which the above relationship is satisfied is also included in the present embodiment.

For the sixth verification experiment, a spark plug sample of Experimental Example 14 was prepared by forming the coating part 30 on the ground electrode 30 as explained above. In the sample, the metal shell was of M12HEX14 type (i.e. the diameter of the mounting thread portion was 12 mm; and the size (diagonal dimension) of the hexagonal portion was 14 mm); the electrode tip of iridium (Jr) with a diameter of 0.6 mm was joined to the front end of the center electrode; the spark gap SG was set to 0.5 mm; the ground electrode 30 was rectangular in shape with a width of 2.7 mm and a thickness of 1.3 mm; and the coating part 80 was formed of platinum (Pt) with a thickness of 0.4 mm on the ground electrode 30. A bench test was performed on the spark plug sample in a velocity field of 10 m/s airflow through the spark gap SG from the free end portion 32 toward the fixed end portion 31 of the ground electrode 30 under the conditions of: an ignition frequency of 50 Hz; a combustion chamber pressure of 0.4 MPa; an atmosphere of nitrogen; and an endurance time of 100 hours. Then, the volume of wear of the base material of the ground electrode 30 caused during the test was measured and evaluated. The measurement and evaluation of the wear volume was made in the first verification experiment.

The evaluation results are shown in TABLE 7.

TABLE 7

| Endurance Time | Comparative Example 1 | Experimental Example 14 |
|---|---|---|
| 100 hr | 2.3 $mm^3$ | 0.5 $mm^3$ |
| Evaluation Result | P | G |

In the sample of Comparative Example where no coating part 80 was formed, the volume of wear of the ground electrode base material was 2.3 $mm^3$. In the sample of Experimental Example 14, on the other hand, the volume of wear of the ground electrode base material was merely 0.5 $mm^3$. In general, there is no possibility of breakage of the ground electrode 30 when the volume of wear of the ground electrode base material is 1.5 $mm^3$. Thus, the sample of Comparative Example was evaluated as "P (not satisfactory)"; and the sample of Experimental Example 14 was evaluated as "G (good)". In the sample of Experimental Example 14, the volume of wear of the ground electrode base material was reduced to a level acceptable as technically effective even though the coating part 40 was formed only on the region of the inner surface 30*c* of the ground electrode 30 defined between the first intersection L11 and the second intersection L20.

It has been shown by the above result of Experimental Example 14 that, as long as the coating part 80 is formed on at least the region of the inner surface of the ground electrode 30 from the first intersection L11 to the second intersection L20, it is possible to effectively suppress or prevent wear of the ground electrode 30. It is particularly apparent from the sixth verification experiment that, although it is known that the bent or curved portion of the ground electrode 30 is susceptible to wear by blowing of sparks as already mentioned above, it is possible by providing the coating part 80 up to at least the second intersection L20 to suppress wear of the bent or curved portion of the ground electrode base material and suppress or prevent the ground electrode 30 from being broken from its basal end portion.

Next, verification was made based on spark plug samples of Experimental Examples 15 to 18 to verify the technical effects of the relationship of 0.7 F≤A≤B between width dimension A of the coating part 80, the width dimension B of the ground electrode 30 and the width (diameter) F of the front end 22*a* of the electrode tip 22. The verification conditions, except the configuration of the coating part 80, were the same as mentioned above. The amount of wear of the ground electrode base material was tested by setting the width dimension A of the coating part 80 set equal to 0.3 F in the sample of Experimental Example 15, 0.7 F in the sample of Experimental Example 16, F in the sample of Experimental Example 17 and B in the sample of Experimental Example 18. Since the diameter F of the front end 22*a* of the electrode tip 22 was 0.6 mm, the width dimension A of the coating part 80 was 0.18 mm, 0.42 mm, 0.6 mm and 2.7 mm. In each sample, the coating part 80 was formed to extend between the first intersection L11 and the second intersection L20 in parallel with the side surface 30*e* of the ground electrode 30.

Figure 31:
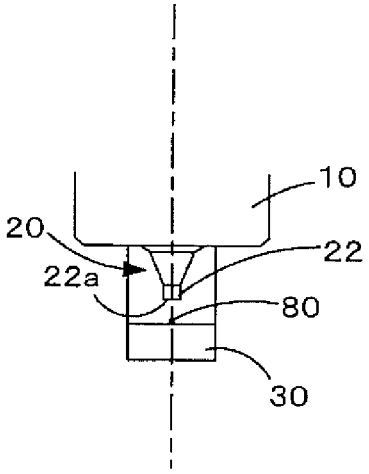
FIG. 31 shows an enlarged right-side view of a front end part of a spark plug with a coating part formed on a ground electrode according to Experimental Example 15 of the present embodiment.
Figure 32:
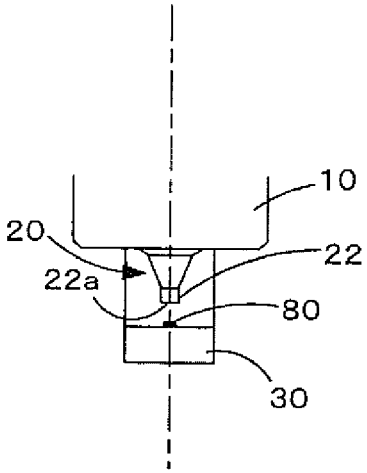
FIG. 32 shows an enlarged right-side view of a front end part of a spark plug with a coating part formed on a ground electrode according to Experimental Example 16 of the present embodiment.
Figure 33:
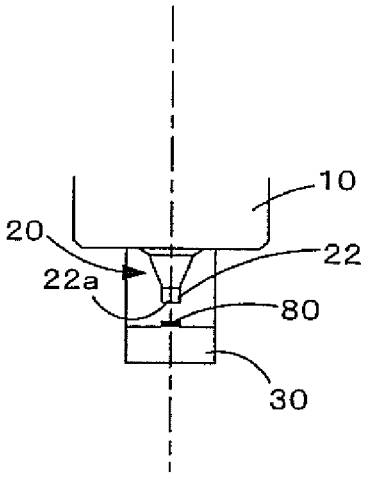
FIG. 33 shows an enlarged right-side view of a front end part of a spark plug with a coating part formed on a ground electrode according to Experimental Example 17 of the present embodiment.
Figure 34:
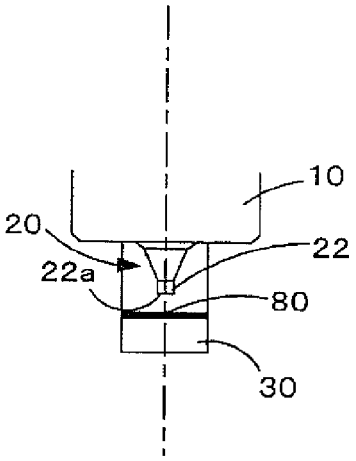
FIG. 34 shows an enlarged right-side view of a front end part of a spark plug with a coating part formed on a ground electrode according to Experimental Example 18 of the present embodiment.

FIG. 31 shows an enlarged right-side view of the front end part of the spark plug with the coating part formed on the ground electrode according to Experimental Example 15 of the present embodiment. FIG. 32 shows an enlarged right-side view of the front end part of the spark plug with the coating part formed on the ground electrode according to Experimental Example 16 of the present embodiment. FIG. 33 shows an enlarged right-side view of the front end part of the spark plug with the coating part formed on the ground electrode according to Experimental Example 17 of the present embodiment. FIG. 34 shows an enlarged right-side view of the front end part of the spark plug with the coating part formed on the ground electrode according to Experimental Example 18 of the present embodiment.

Figure 35:
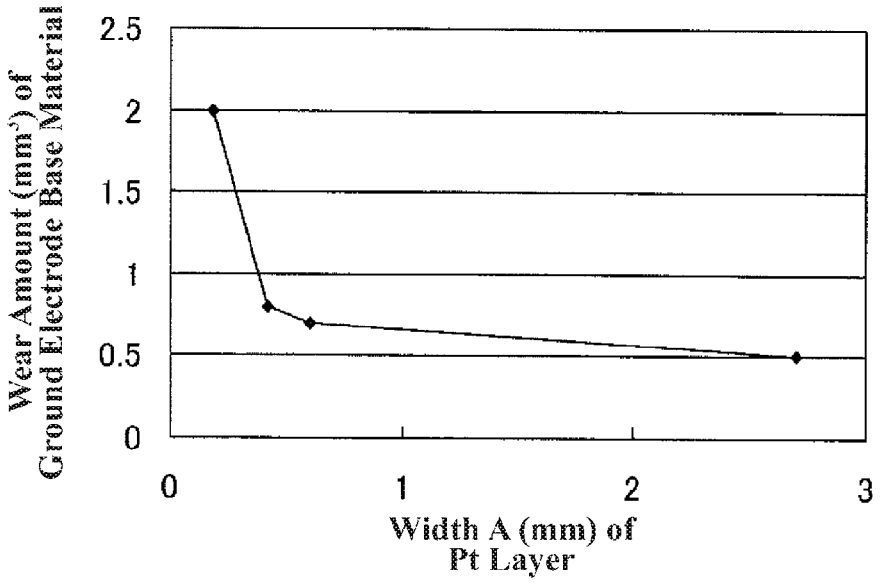
FIG. 35 shows a graph illustrating the amount of wear of ground electrode base material, with respect to different widths of the coating part, as texted by Experimental Examples 15 to 18.

The evaluation results are shown in TABLE 8 and FIG. 35. TABLE 8 shows the evaluation results of Experimental Examples 15 to 18 about the volume of wear of the ground electrode base material with respect to different widths of the coating part. FIG. 35 shows a graph illustrating the amount of wear of the ground electrode base material, with respect to different widths of the coating part, as tested by Experimental Examples 15 to 18.

TABLE 8

| | Width A (mm) of Pt layer | | | |
|---|---|---|---|---|
| Endurance Time | Experimental Example 15 0.3 F | Experimental Example 16 0.7 F | Experimental Example 17 F | Experimental Example 18 B |
| 100 hr | 2.0 $mm^3$ | 0.8 $mm^3$ | 0.7 $mm^3$ | 0.5 $mm^3$ |
| Evaluation Result | P | G | G | G |

In Experimental Example 15 where the width dimension A of the coating part 80 was set equal to 0.3 F, the volume of wear of the ground electrode base material was 2 $mm^3$. By contrast, the volume of wear of the ground electrode base material was merely 0.8 $mm^3$ in Experimental Example 16 where the width dimension A of the coating part 80 was set equal to 0.7 F; 0.7 $mm^3$ in Experimental Example 17 where the width dimension A of the coating part 80 was set equal to F; and 0.5 $mm^3$ in Experimental Example 18 where the width dimension A of the coating part 80 was set equal to B. According to the above-mentioned evaluation criteria, the sample of Experimental Example 15 was evaluated as "P (not satisfactory)"; and the samples of Experimental Examples 16 to 18 were evaluated as "G (good)". As shown in FIG. 35, the volume of wear of the ground electrode base material was significantly reduced in the range of the width dimension A of the coating part 80≥0.7 F. It is also known that: the electrode tip 22 of the center electrode 20 wears during use and rounds off such that a linear region of the end face of the front end 22*a* (i.e. region of the end face in parallel with the ground electrode 30) becomes about 70% before the replacement time. For these reasons, it is preferable that the width dimension A of the coating part is 0.7 F or more.

It has been shown by the evaluation results of Experimental Examples 15 to 18 that, when the dimension of the coating part 80 in the width direction is set to satisfy the relationship of satisfy the relationship of 0.7 F≤A≤B, it is possible to suppress wear of the ground electrode base material including the bent or curved portion and prevent the ground electrode 30 from being broken from its basal end portion.

Verification was further made based on spark plug samples of Experimental Examples 19 and 20 to test, in the case of providing a plurality of coating parts 80, changes in the volume of wear of the ground electrode base material with changes in the distance between the coating parts 80. In Experimental Example 19, two plate-shaped coating parts 80 is arranged in parallel with the end face of the free end portion 32 of the ground electrode 30; and the spacing (distance) between these two coating parts 80 is formed in parallel with the end face of the free end portion 32. In Experimental Example 20, two plate-shaped coating parts 20 are formed perpendicular to the end face of the free end portion 32 of the ground electrode 30 (i.e. in parallel with the side surface 30*e*); and the spacing (distance) between these two coating parts 80 is formed in parallel with the side surface 30*e*. Based on these two examples, consideration was also given to the influence of the direction of the clearance on the wear of the ground electrode base material.

Figure 36:
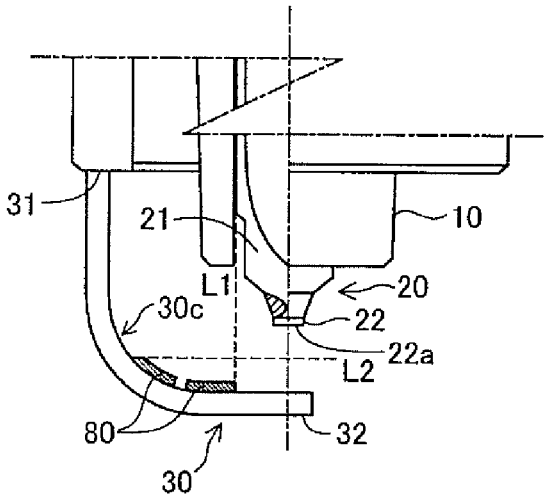
FIG. 36 shows an enlarged partially sectional elevation view of a front end part of a spark plug with a coating part formed on a ground electrode according to Experimental Example 19 of the present embodiment.
Figure 37:
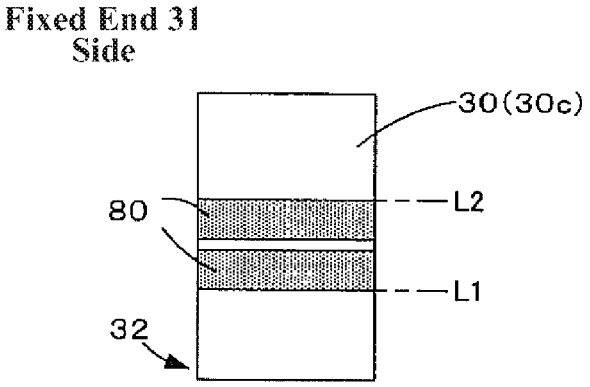
FIG. 37 shows an enlarged plan view of the front end part of the spark plug with the coating part formed on the ground electrode according to Experimental Example 19 of the present embodiment.
Figure 38:
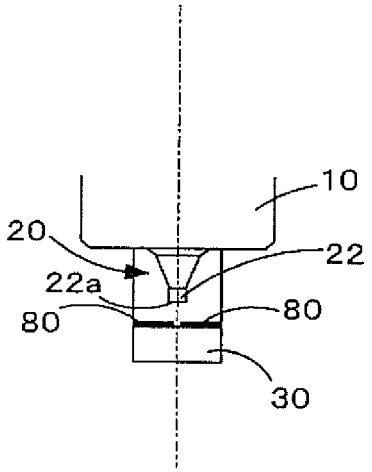
FIG. 38 shows an enlarged right-side view of a front end part of a spark plug with a coating part formed on a ground electrode according to Experimental Example 20 of the present embodiment.
Figure 39:
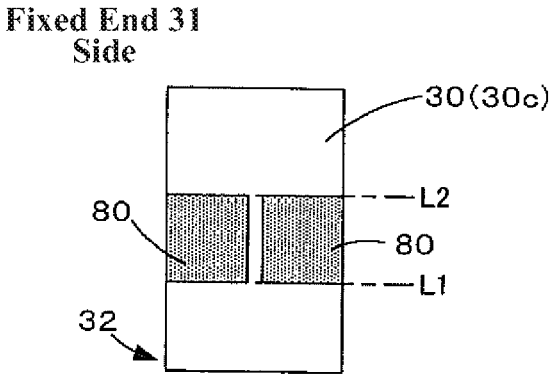
FIG. 39 shows an enlarged plan view of the front end part of the spark plug with the coating part formed on the ground electrode according to Experimental Example 20 of the present embodiment.

FIG. 36 shows an enlarged partially sectional elevation view of the front end part of the spark plug with the coating part formed on the ground electrode according to Experimental Example 19 of the present embodiment. FIG. 37 shows an enlarged plan view of the front end part of the spark plug with the coating part formed on the ground electrode according to Experimental Example 19 of the present embodiment. FIG. 38 shows an enlarged right-side view of the front end part of the spark plug with the coating part formed on the ground electrode according to Experimental Example 20 of the present embodiment. FIG. 39 shows an enlarged plan view of the front end part of the spark plug with the coating part formed on the ground electrode according to Experimental Example 20 of the present embodiment.

The evaluation results are shown in TABLES 9 and 10. TABLE 9 shows the evaluation results of Experimental Examples 19 and 20 about the volume of wear of the ground electrode base material with respect to different width dimensions and thicknesses of the coating part.

TABLE 9

| | | Thickness (mm) of Pt layer | | | |
|---|---|---|---|---|---|
| | | 0.1 | 0.2 | 0.3 | 0.4 |
| Distance D (mm) between Pt Layers | 0.1 | G | G | P | P |
| | 0.2 | G | G | P | P |
| | 0.3 | P | G | G | P |
| | 0.4 | P | G | G | G |

TABLE 10

| | | Thickness (mm) of Pt layer | | | |
|---|---|---|---|---|---|
| | | 0.1 | 0.2 | 0.3 | 0.4 |
| Distance D (mm) between Pt Layers | 0.1 | G | G | P | P |
| | 0.2 | G | G | P | P |
| | 0.3 | P | G | G | P |
| | 0.4 | P | G | G | G |

The volumetric wear amount of the ground electrode base material in each of the samples of Experimental Examples 19 and 20 was evaluated according the above-mentioned evaluation criteria. As is seen from TABLES 9 and 10, there was a tendency that: the evaluation results were "P (not satisfactory)" when the two coating parts 80 were formed with a large thickness T and with a large distance D therebetween; and the evaluation results were also "P (not satisfactory)" when the two coating parts 80 were formed with a small thickness T and with a small distance D therebetween. More specifically, the evaluation results were "G (good)" when the distance D was 0.1 mm to 0.2 mm at the thickness T of 0.1 mm. The evaluation results were "G (good)" when the distance D was 0.1 mm to 0.4 mm at the thickness T of 0.2 mm. The evaluation results were "G (good)" when the distance D was 0.3 mm to 0.4 mm at the thickness T was 0.3 mm. The evaluation result was "G (good)" when the distance D was 0.4 mm at the thickness T of 0.4 mm.

It has been shown by the above results that, even in the case where the coating part 80 is in the form of a plurality of separate layers, it is possible to suppress or prevent volumetric wear of the ground electrode base material by satisfying the relationship of T≥D in the case of T≥0.2 mm and D≤0.2 mm in the case of T<0.2 mm.

Furthermore, verification was made based on Experimental Examples 20 to 45 as shown in FIGS. 40 to 45 to verify the effects of the relationship that, when the ground electrode 30, the coating part 80 and the electrode tip 22 are viewed from the end face side of the free end portion 32 of the ground electrode 30, the center line of the coating part 80 perpendicular to the width direction is in the range of the width of the electrode tip 22. FIGS. 40A and 40B schematically show the positional relationship between the coating part and the front end of the electrode top in Experimental Examples 20 to 24 where (a) shows an elevation view of the front end part of the spark plug; and (b) shows a right-side view of the front end part of the spark plug, i.e., a side view of the ground electrode 30, the coating part 80 and the electrode tip 20 as viewed from the end face side of the front end 32 of the ground electrode 30. It is herein assumed that projection points S11 and S21 are respectively given by projecting a center point S10 of the front face 22*a* of the electrode tip 22 and a center point S20 of the coating part 80 onto a plane VP1 parallel with the width direction of the ground electrode 30 (i.e. parallel with the end face of the free end portion 32 of the ground electrode 30). A horizontal distance between these two projection points S11 and S21 corresponds to a displacement J between the center point S10 of the front face 22*a* of the electrode tip 22 and the center point S20 of the coating part 80. This positional relationship can also be regarded as a displacement of center lines S1 and S2 that respectively pass through the projection points S11 and S21. The centers of the coating part and the electrode tip in the longitudinal direction of the ground electrode 30 (i.e. the direction of the ground electrode from the free end to the fixed end) are originally displaced from each other. For this verification, spark plug samples were prepared in which: the metal shell was of M12HEX14 type; the electrode tip of iridium (Jr) with a diameter of 0.8 mm was joined to the front end of the center electrode; the spark gap SG was set to 0.5 mm; the ground electrode 30 was rectangular in shape with a width of 2.7 mm and a thickness of 1.3 mm; and the coating part 80 was formed with a width of 0.8 mm on the ground electrode 30. A durability test was performed on each of the spark plug samples by mounting the sample plug to a four-cycle gasoline engine and operating the engine under the conditions of, an engine rotation speed of 6000 rpm, a load of −20 kPa, an A/F ratio of 12.0 and an endurance time of 200 hours. The evaluation (measurement) of the wear volume was made in the same manner as in the first verification experiment.

Figure 42:
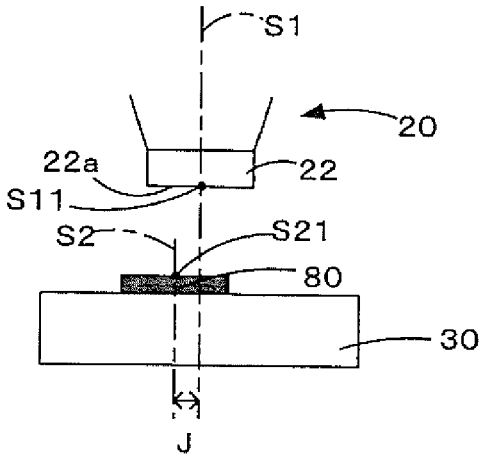
FIG. 42 shows an enlarged right-side view of a front end part of a spark plug with a coating part formed on a ground electrode according to Experimental Example 21 of the present embodiment.
Figure 43:
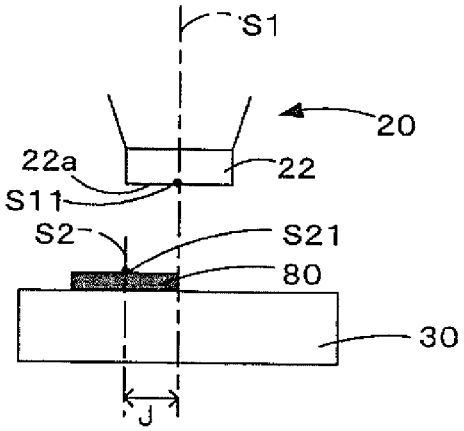
FIG. 43 shows an enlarged right-side view of a front end part of a spark plug with a coating part formed on a ground electrode according to Experimental Example 22 of the present embodiment.
Figure 44:
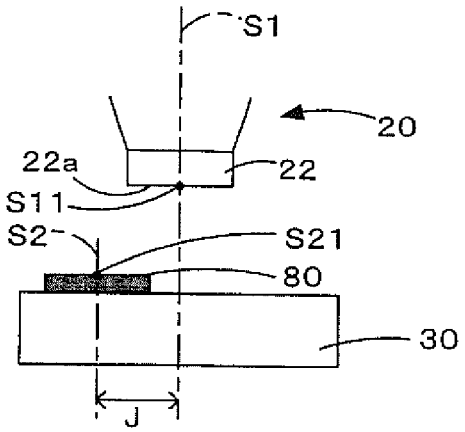
FIG. 44 shows an enlarged right-side view of a front end part of a spark plug with a coating part formed on a ground electrode according to Experimental Example 23 of the present embodiment.
Figure 45:
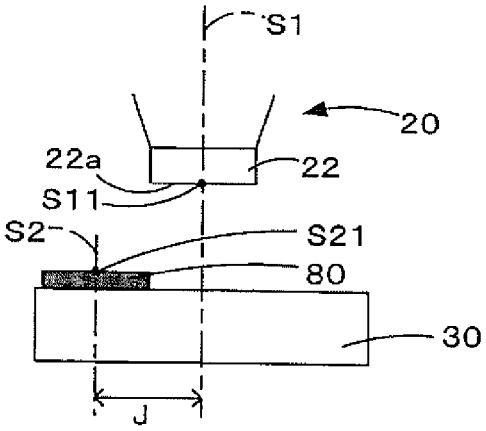
FIG. 45 shows an enlarged right-side view of a front end part of a spark plug with a coating part formed on a ground electrode according to Experimental Example 25 of the present embodiment.

FIG. 41 shows an enlarged right-side view of the front end part of the spark plug with the coating part formed on the ground electrode according to Experimental Example 20 of the present embodiment. FIG. 42 shows an enlarged right-side view of the front end part of the spark plug with the coating part formed on the ground electrode according to Experimental Example 21 of the present embodiment. FIG. 43 shows an enlarged right-side view of the front end part of the spark plug with the coating part formed on the ground electrode according to Experimental Example 22 of the present embodiment. FIG. 44 shows an enlarged right-side view of the front end part of the spark plug with the coating part formed on the ground electrode according to Experimental Example 23 of the present embodiment. FIG. 45 shows an enlarged right-side view of the front end part of the spark plug with the coating part formed on the ground electrode according to Experimental Example 25 of the present embodiment. In the sample of Experimental Example 20, the displacement J between the center of the coating part 80 and the center of the electrode tip 22 in the width direction of the ground electrode 30 was set to 0. The displacement J was set to 0.2 in the sample of Experimental Example 21. The displacement J was set to 0.4 mm in the sample of Experimental Example 22. The displacement J was set to 0.6 mm in the sample of Experimental Example 23. The displacement J was set to 0.8 mm in the sample of Experimental Example 24. As mentioned above, the width of the coating part 80 was set to 0.8 mm; and the width of the electrode tip 22 was set to 0.8 mm. It means that, in the case of displacement J≤0.4 mm, the center line S2 of the coating part 80 perpendicular to the width direction was in the range of the width of the electrode tip 22 when the ground electrode 30, the coating part 80 and the electrode tip 22 were viewed from the end face side of the front end 32 of the ground electrode 30.

Figure 46:
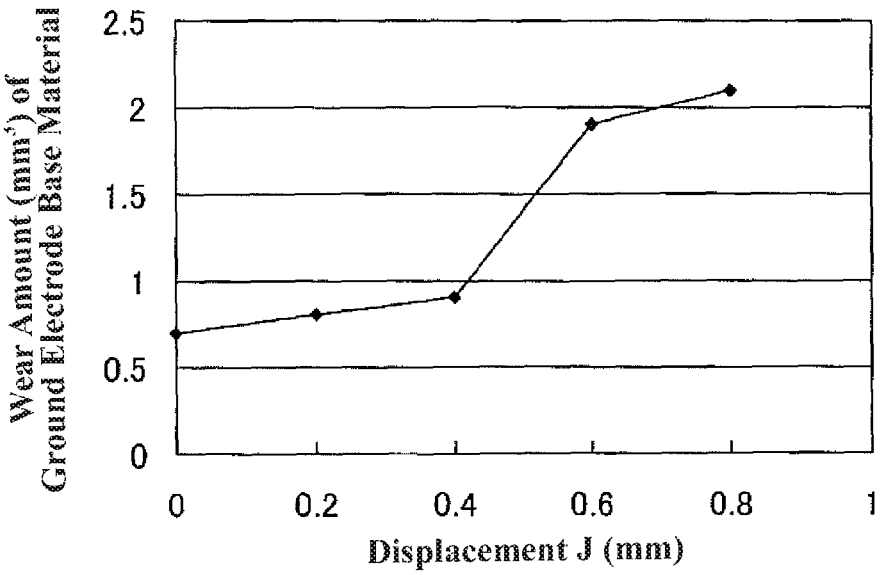
FIG. 46 shows a graph illustrating the amount of volumetric wear of ground electrode base material, with respect to the displacement, as tested by Experimental Examples 20 to 24.
Figure 47:
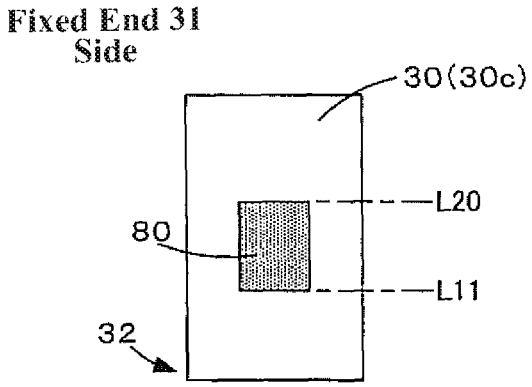
FIG. 47 shows an enlarged plan view of a front end part of a first modification example of the spark plug as used in the sixth verification experiment.
Figure 48:
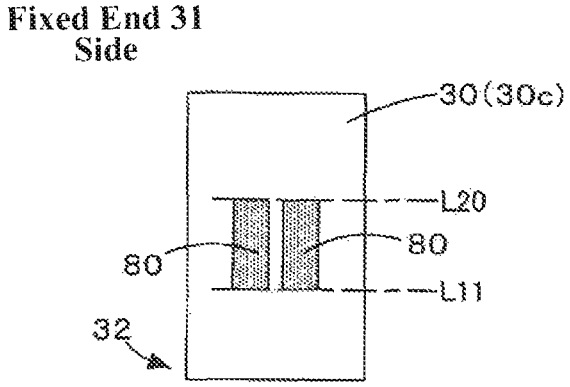
FIG. 48 shows an enlarged plan view of a front end part of a second modification example of the spark plug as used in the sixth verification experiment.
Figure 49:
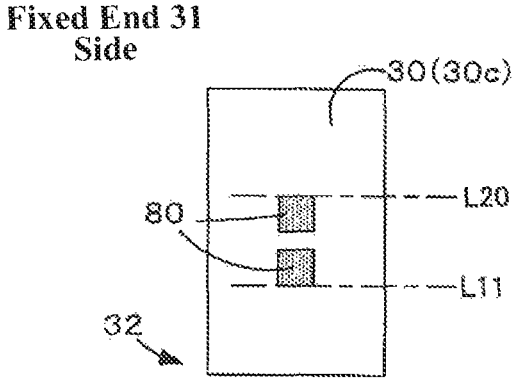
FIG. 49 shows an enlarged plan view of a front end part of a third modification example of the spark plug as used in the sixth verification experiment.
Figure 50:
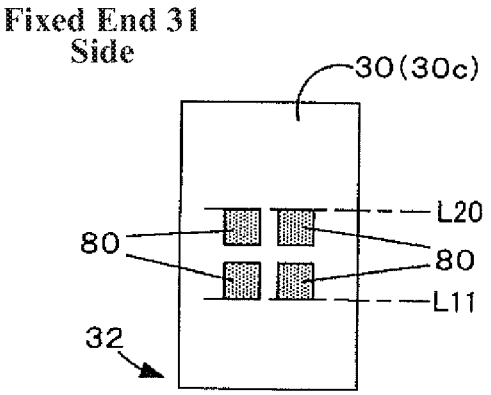
FIG. 50 shows an enlarged plan view of a front end part of a fourth modification example of the spark plug as used in the sixth verification experiment.
Figure 51:
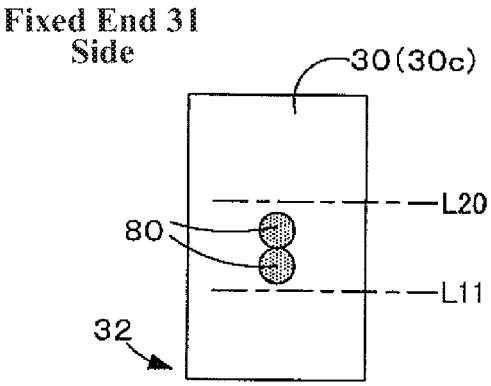
FIG. 51 shows an enlarged plan view of a front end part of a fifth modification example of the spark plug as used in the sixth verification experiment.
Figure 52:
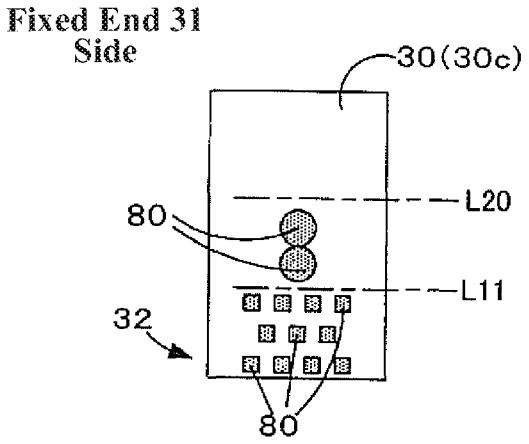
FIG. 52 shows an enlarged plan view of a front end part of a sixth modification example of the spark plug as used in the sixth verification experiment.

The evaluation results are shown in TABLE 11 and FIG. 46. FIG. 46 shows a graph showing the volumetric wear amount of the ground electrode base material, with respect to the displacement, as tested by Experimental Examples 20 to 24.

TABLE 11

| | Displacement (mm) | Wear amount ($mm^3$) | Evaluation Result |
|---|---|---|---|
| Experimental Example 20 | 0 | 0.7 | G |
| Experimental Example 21 | 0.2 | 0.8 | G |
| Experimental Example 22 | 0.4 | 0.9 | G |

TABLE 11-continued

| | Displacement (mm) | Wear amount ($mm^3$) | Evaluation Result |
|---|---|---|---|
| Experimental Example 23 | 0.6 | 1.9 | P |
| Experimental Example 24 | 0.8 | 2.1 | P |

The volumetric wear amount of the ground electrode base material was 0.7 $mm^3$ when the displacement J was 0, that is, the center of the coating part 80 was in agreement in the center of the electrode tip 22. The volumetric wear amount of the ground electrode base material was 0.8 $mm^3$ when the displacement J was 0.2 mm. The volumetric wear amount of the ground electrode base material was 0.9 $mm^3$ when the displacement J was 0.4 mm. These values of the displacement J correspond to the case where, when the ground electrode 30, the coating part 80 and the electrode tip 22 are viewed from the end face side of the free end portion 32 of the ground electrode 30, the center line S2 of the coating part 80 perpendicular to the width direction is in the range of the width of the electrode tip 22. The samples with these displacement values were evaluated as "G (good)" as the volumetric wear amount of the ground electrode base material was less than 1.5 $mm^3$. On the other hand, the volumetric wear amount of the ground electrode base material was 1.9 $mm^3$ when the displacement J was 0.6 mm. The volumetric wear amount of the ground electrode base material was 2.1 $mm^3$ when the displacement J was 0.6 mm. These values of the displacement J correspond to the case where, when the ground electrode 30, the coating part 80 and the electrode tip 22 are viewed from the end face side of the free end portion 32 of the ground electrode 30, the center line S2 of the coating part 80 perpendicular to the width direction is not in the range of the width of the electrode tip 22. The samples with these displacement values were evaluated as "P (not satisfactory)" as the volumetric wear amount of the ground electrode base material was 1.5 $mm^3$ or more.

In the graph of FIG. 46, the gradient of the characteristic line is small and is not almost changed in the range of the displacement J from 0 mm to 0.4 mm. However, the gradient of the characteristic line becomes large and becomes abruptly change when the displacement J exceeds 0.4 mm. It has been shown by the above results that it is possible to effectively reduce the volumetric wear amount of the ground electrode base material in the case where the displacement J is 0.4 mm or less, that is, the center line S2 of the coating part 80 perpendicular to the width direction is in the range of the width of the electrode tip 22 when the ground electrode 30, the coating part 80 and the electrode tip 22 are viewed from the end face side of the free end portion 32 of the ground electrode 30. The displacement J may be defined as, when the center of the coating part 80 and the center of the front end 22*a* of the electrode tip 22 are projected onto a plane parallel with the width direction of the ground electrode 30, a horizontal distance between those two projected center points. The displacement J may alternatively be defined as, when the center point S20 of the coating part 80 and the center point S10 of the front end 22*a* of the electrode tip 22 are projected onto a plane parallel with the inner surface 30*c* of the ground electrode 30 and further projected onto a plane in parallel with the width direction of the ground electrode 30, a distance between the resulting two projection points. The positional relationship between the coating part 80 and the front end 22*a* of the electrode tip 22 may be defined as follows: on the plane VP1, half or more of the width of the front end 22*a* of the electrode tip 22 overlaps the coating part 80.

It is apparent from the respective experimental examples that the electrode tip 22, the ground electrode 30 and the coating part 80 used in the above first to fifth verification experiments satisfy the relationship of 0.7 F≤A≤B and the relationship that, when the ground electrode 30, the coating part 80 and the electrode tip 22 are viewed from the end face side of the free end portion 32 of the ground electrode 30, the center line of the coating part 80 perpendicular to the width direction is in the range of the width of the electrode tip 22.

The front end part of the spark plug, with modification examples of the coating part 80 in the sixth verification experiment, are shown by enlargement in FIGS. 47 to 52. In the first modification example of FIG. 47, one rectangular coating part 80 is arranged in the center of the region of the ground electrode 30 between the first intersection L11 and the second intersection L20. In the second modification example of FIG. 48, two rectangular coating parts 80 are arranged in the center of the region of the ground electrode 30 between the first intersection L11 and the second intersection L20 such that the distance between the coating parts is in parallel with the side surface 30*e* of the ground electrode 30. In the third modification example of FIG. 49, two rectangular coating parts 80 are arranged in the center of the region of the ground electrode 30 between the first intersection L11 and the second intersection L20 such that the distance between the coating parts is perpendicular to the side surface 30*e* of the ground electrode 30. In the fourth modification example of FIG. 50, four rectangular coating parts 80 are arranged in the center of the region of the ground electrode 30 between the first intersection L11 and the second intersection L20. In the fifth modification example of FIG. 51, two circular coating parts 80 are arranged in the center of the region of the ground electrode 30 between the first intersection L11 and the second intersection L20 in parallel with the side surface 30*e* of the ground electrode 30. In the sixth modification example of FIG. 52, a plurality of coating parts 80 are arranged on the free end portion 32 side of the ground electrode 30 in addition to the circular coating parts 80 of the fifth modification example. In each of these modification examples, the coating part 80 is formed in the region of the ground electrode 30 between the first intersection L11 and the second intersection L20 so as to satisfy the relationship of 0.7 F≤A≤B and to satisfy the relationship that, when the ground electrode 30, the coating part 80 and the electrode tip 22 are viewed from the end face side of the free end portion 32 of the ground electrode 30, the center line of the coating part 80 perpendicular to the width direction is in the range of the width of the electrode tip 22. As verified above by the first verification experiment, the coating part 80 may also be formed on the regions of the ground electrode 30 from the first intersection L11 to the free end portion 32 and from the second intersection L20 to the fixed end portion 31.

Modifications:

In each of the above examples, the inner surface 30*c* of the ground electrode 30 is smooth. Alternatively, the ground electrode 30 may be formed with a protruding portion as a tip portion or may be formed with a groove portion.

Although the present invention has been described with reference to the above specific embodiment and examples, the above embodiment and examples are intended to facilitate understanding of the present invention and are not intended to limit the present invention thereto. Various changes and modifications can be made without departing from the scope of the present invention. The present invention includes equivalents thereof. For example, any of the technical features mentioned above in "Summary of the Invention" and "Description of the Embodiments" may be replaced or combined as appropriate in order to solve a part or all of the above-mentioned problems or achieve a part or all of the above-mentioned effects. Any of these technical features, if not explained as essential in the present specification, may be eliminated as appropriate.

DESCRIPTION OF REFERENCE NUMERALS

3: Ceramic resistor
4: Seal member
5: Gasket
8: Packing
10: Insulator
10*a*: Front end portion
12: Axial hole
13: Leg portion
15: Diameter-decreasing portion
17: Front body portion
18: Rear body portion
19: Middle body portion
20: Center electrode
21: Center electrode base material
22: Electrode tip
22*a*: Front end
25: Core
30: Ground electrode
30*a*: Insulator-facing site
30*b*: Center electrode-facing site
30*c*: Inner surface
30*d*: Outer surface
30*e*: Side surface
30*g*: Center of gravity
30*h*: Continuing region
30*f*: Imaginary line
31: Fixed end portion
32: Free end portion
40: Terminal electrode
50: Metal shell
51: Tool engagement portion
52: Mounting thread portion
53: Crimp portion
54: Seal portion
57: Front end face
60: Protruding portion
80: Coating part
81: Protruding part
82: Layer part
83: Second coating part
100: Spark plug
150: Cylinder head
151: Mounting thread hole
OL: Axis
SG: Spark gap
SG1: Midpoint
S1, S2: Center line
S10, S20: Center point
S11, S21: Projection point
L1: Imaginary line
P1: Imaginary plane
L11: First intersection
L20: Second intersection
X1: Intersection point Having described the invention, the following is claimed:

1. A spark plug comprising:

an insulator having an axial hole;

a metal shell surrounding an outer circumference of the insulator;

a center electrode having a center electrode base material disposed in the axial hole and an electrode tip joined to the center electrode base material and exposed outside from a front end portion of the metal shell; and a ground electrode having a fixed end portion fixed to the metal shell and a free end portion located at a predetermined gap apart from a front end of the electrode tip, the ground electrode having: an inner surface facing the center electrode and the insulator; and an outer surface connecting one end to the other end of the inner surface in a width direction of the ground electrode and including a back surface located opposite the inner surface, the ground electrode having a center electrode-facing site opposed to and facing the center electrode, wherein the spark plug further comprises a coating part formed of noble metal or noble metal alloy such that the coating part covers at least a region of the inner surface from a first intersection to a second intersection without covering the back surface, where the first intersection is defined as containing an intersection point at which an imaginary line extending from an outer circumference of the center electrode base material at a side of the fixed end portion to the ground electrode intersects the ground electrode; and the second intersection is defined as an intersection at which an imaginary plane passing through a midpoint of the predetermined gap and extending in parallel with an end face of the front end intersects the ground electrode;

wherein the spark plug satisfies a relationship of $0.7F \leq A \leq B$ where A is a dimension of the coating part in the width direction; B is a dimension of the ground electrode in the width direction; and F is a width of the front end of the electrode tip; and wherein, when the ground electrode, the coating part and the electrode tip are visually observed from a side of the free end portion, a center line of the coating part perpendicular to the width direction is in a range of the width of the electrode tip.

2. The spark plug according to claim 1, wherein the first intersection is as an intersection at which an imaginary plane containing the imaginary line, passing tangent to the outer circumference of the center electrode base material and extending to the ground electrode intersects the ground electrode.

3. The spark plug according to claim 1, wherein the center electrode-facing site, which is opposed to and facing the center electrode, is included in the free end portion of the ground electrode; and wherein the coating part covers a region of the inner surface from an insulator-facing site, which is opposed to and facing a front end portion of the insulator at a side of the fixed end portion, to the center electrode-facing site.

4. The spark plug according to claim 1, wherein the coating part covers the whole of the inner surface.

5. The spark plug according to claim 1, wherein the coating part further covers a region of the outer surface continuing to the inner surface.

6. The spark plug according to claim 5, wherein the region of the outer surface continuing to the inner surface is a region located closer to the inner surface than an imaginary line passing through the outer surface from a geometrical center of gravity of an end face of the ground electrode when visually observed from the side of the free end portion and extending in parallel with the inner surface.

7. The spark plug according to claim 1, wherein the coating part has a thickness of 3 μm to 400 μm.

8. The spark plug according to claim 1, wherein a thickness of the coating part formed on the center electrode-facing site is larger than a thickness of the coating part formed on any site other than the center electrode-facing site.

9. The spark plug according to claim 1, wherein a composition of the coating part formed on the center electrode-facing site is different from a composition of the coating part formed on any site other than the center electrode-facing site.

* * * * *